US011165191B2

(12) United States Patent
Choi et al.

(10) Patent No.: US 11,165,191 B2
(45) Date of Patent: Nov. 2, 2021

(54) RECEPTACLE CONNECTOR

(71) Applicant: LS MTRON LTD., Anyang-si (KR)

(72) Inventors: Jung Hoon Choi, Anyang-si (KR); Hyun Woo Lee, Anyang-si (KR); Soo Hwan Park, Anyang-si (KR)

(73) Assignee: LS MTRON LTD., Anyang-si (KR)

( * ) Notice: Subject to any disclaimer, the term of this patent is extended or adjusted under 35 U.S.C. 154(b) by 0 days.

(21) Appl. No.: 16/961,915

(22) PCT Filed: Nov. 28, 2018

(86) PCT No.: PCT/KR2018/014791
§ 371 (c)(1),
(2) Date: Jul. 13, 2020

(87) PCT Pub. No.: WO2020/111304
PCT Pub. Date: Jun. 4, 2020

(65) Prior Publication Data

US 2020/0388951 A1 Dec. 10, 2020

(51) Int. Cl.
*H01R 13/52* (2006.01)
*H01R 24/60* (2011.01)

(52) U.S. Cl.
CPC ..... *H01R 13/5202* (2013.01); *H01R 24/60* (2013.01)

(58) Field of Classification Search
CPC ..... H01R 13/52; H01R 13/5202; H01R 13/6581; H01R 13/6582; H01R 24/60
See application file for complete search history.

(56) References Cited

U.S. PATENT DOCUMENTS 10,096,932 B2 10/2018 Chang et al.
10,468,809 B2 * 11/2019 Zhao ..... H01R 13/6593
(Continued)

FOREIGN PATENT DOCUMENTS

CN 107666042 A 2/2018
JP 2000091036 A 3/2000
(Continued)

OTHER PUBLICATIONS

Chinese Office Action for related Chinese Application No. 201880088289.3; dated Mar. 4, 2021; (8 pages).
(Continued)

*Primary Examiner* — Oscar C Jimenez
(74) *Attorney, Agent, or Firm* — K&L Gates LLP

(57) ABSTRACT

The present invention relates to a receptacle connector comprising a plurality of contacts for electrically connecting a plug connector and a substrate coupled to an electronic device; an insulation part to which the contacts are coupled; a shell to which the insulation part is coupled; a cover to which the shell is coupled; and a sealing member coupled to the shell so as to seal a gap between the electronic device and the shell. The shell includes a shell body; a support member; and a protruding member formed on the support member. The support member protrudes forwards from the cover and is coupled to the cover so as to be located on the outside of the cover, and the protruding member protrudes outwards from the support member and is coupled to the support member so as to limit a distance by which the sealing member can move rearwards.

20 Claims, 15 Drawing Sheets

(56) References Cited

U.S. PATENT DOCUMENTS

| | | | | |
|---|---|---|---|---|
| 11,063,383 | B2 * | 7/2021 | Chang | H01R 13/502 |
| 2020/0266572 | A1 * | 8/2020 | Chang | H01R 13/5227 |
| 2020/0412067 | A1 * | 12/2020 | Xu | H01R 13/6596 |
| 2021/0119384 | A1 * | 4/2021 | Kawasaki | H01R 13/5202 |

FOREIGN PATENT DOCUMENTS

| | | | |
|---|---|---|---|
| JP | 2012009357 | A | 1/2012 |
| KR | 20080066865 | A | 7/2008 |
| KR | 20150121654 | A | 10/2015 |
| KR | 20160042752 | A | 4/2016 |
| KR | 20170033318 | A | 3/2017 |
| KR | 20180108438 | A | 10/2018 |
| KR | 20180119059 | A | 11/2018 |

OTHER PUBLICATIONS

International Search Report for related International Application No. PCT/KR2018/014791; dated Jun. 4, 2020 (5 pages).
Written Opinion for related International Application No. PCT/KR2018/014791; dated Jun. 4, 2020; (5 pages).

* cited by examiner

[Fig. 1]
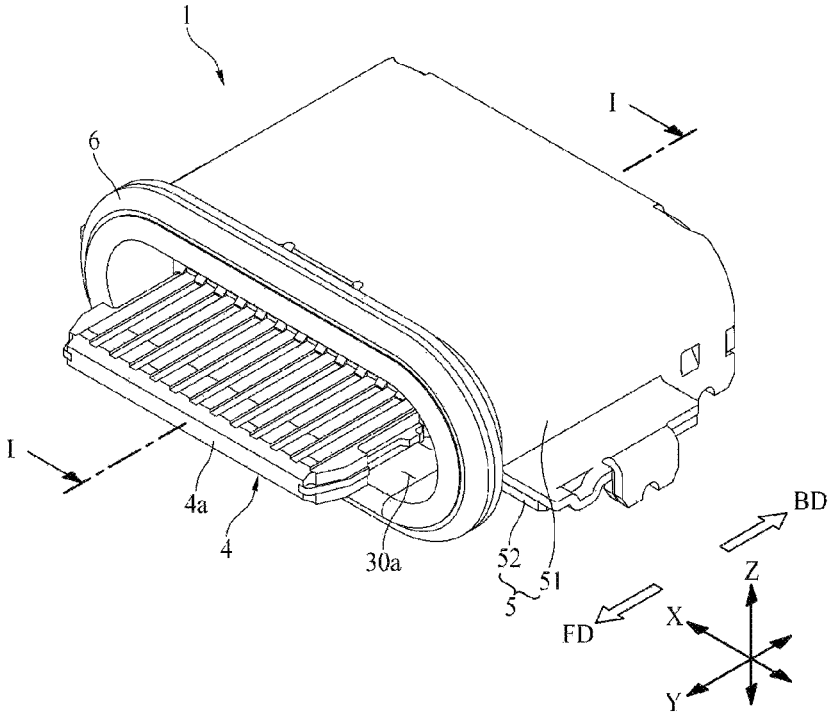

[Fig. 2]
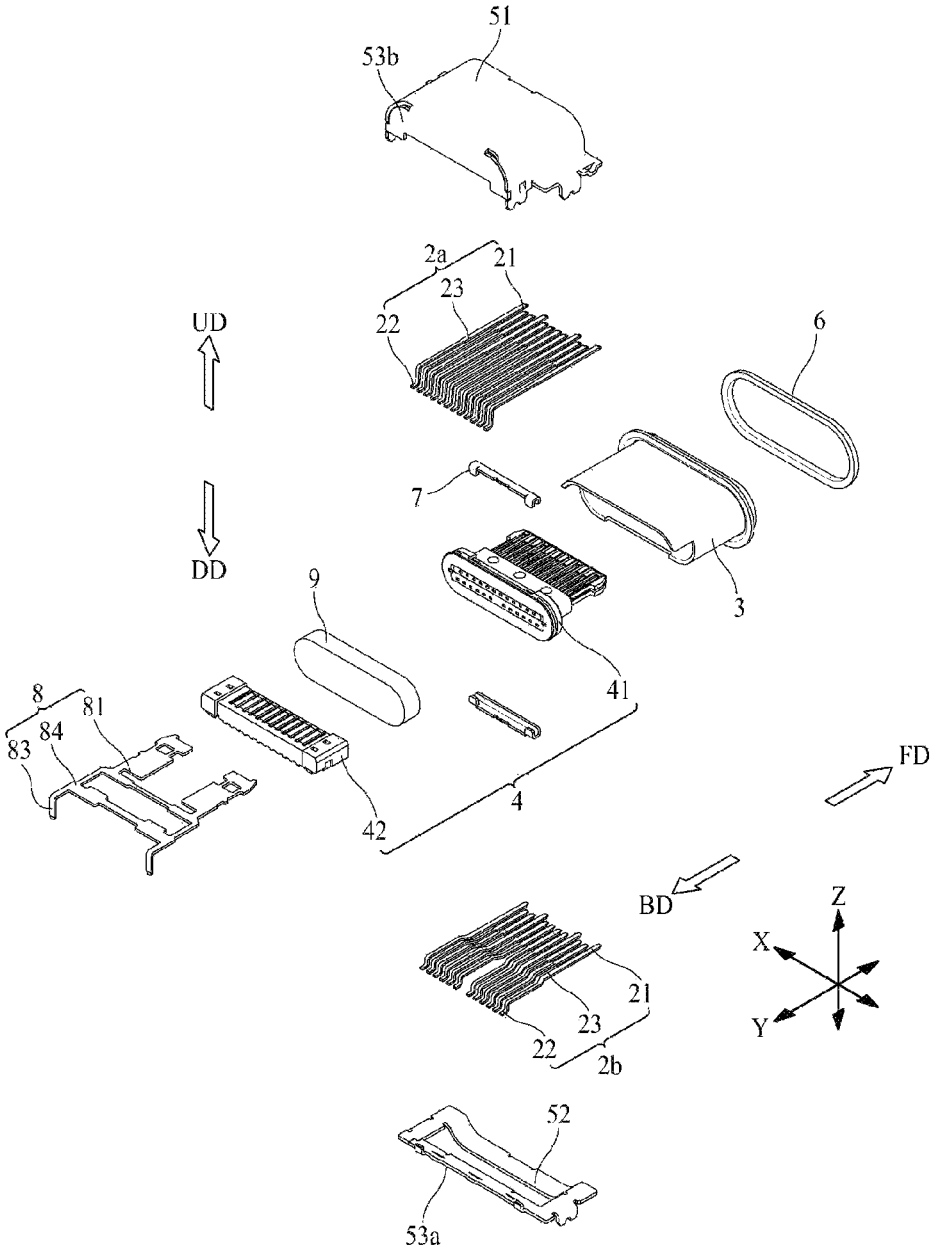

[Fig. 3]
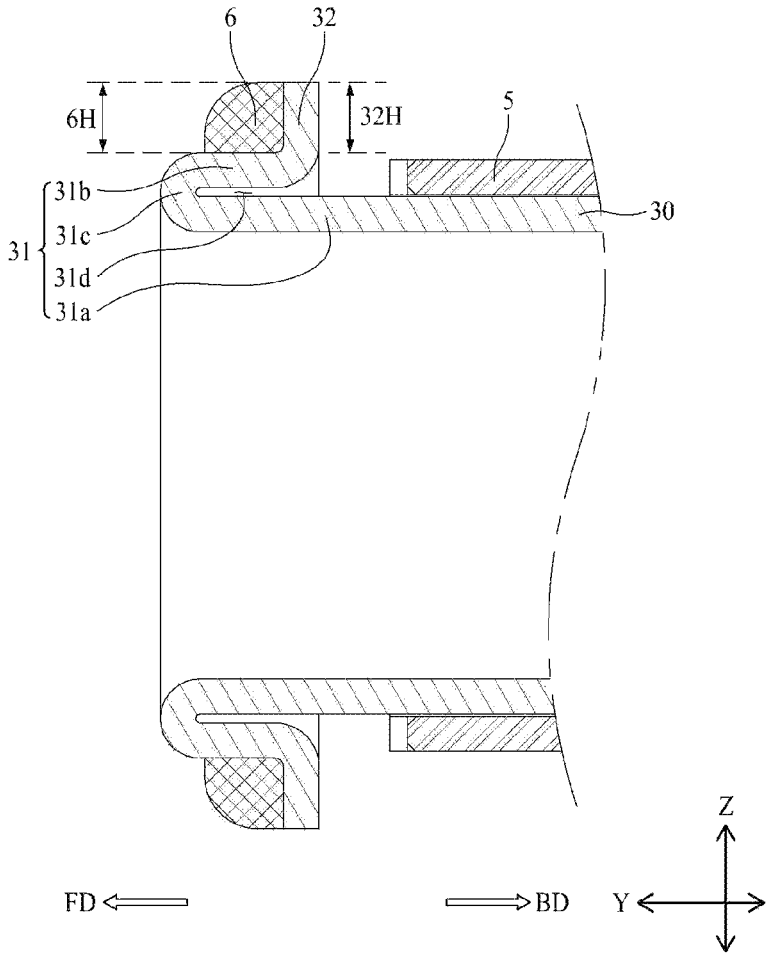

[Fig. 4]
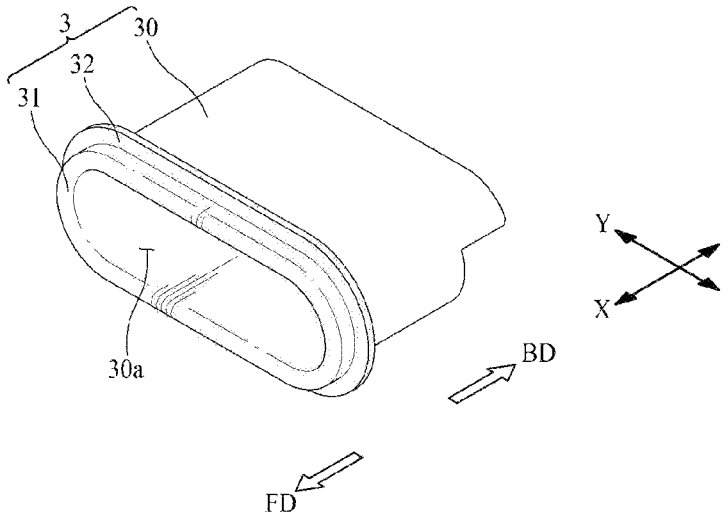
[Fig. 5]
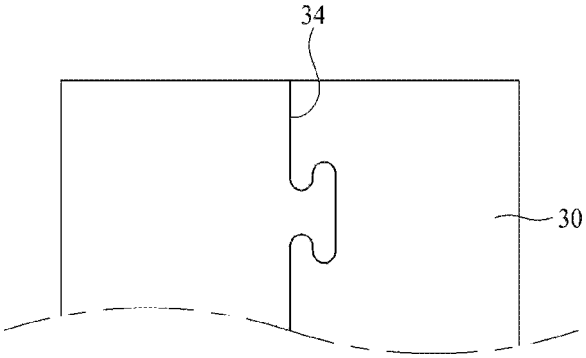

[Fig. 6]
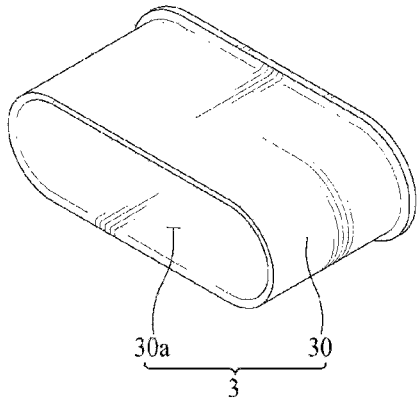
[Fig. 7]
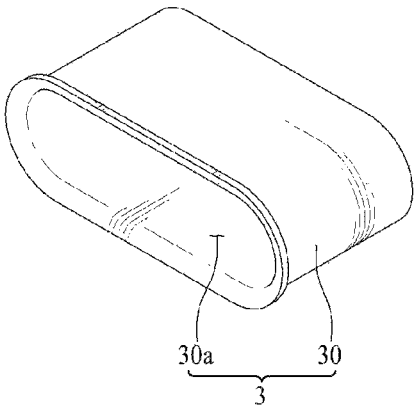

[Fig. 8]
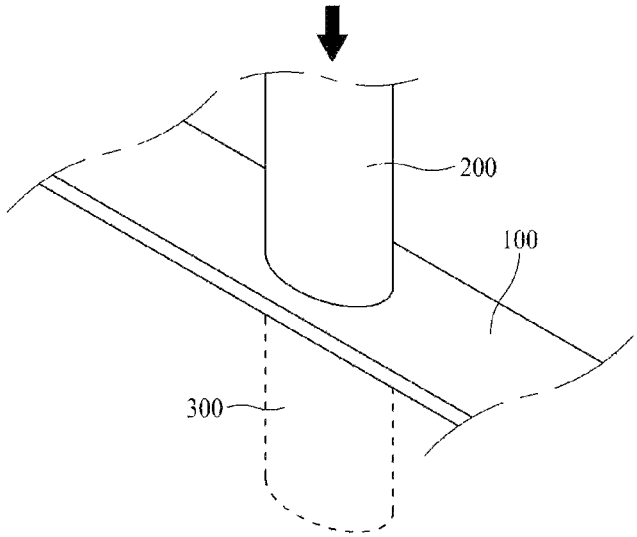

[Fig. 9]
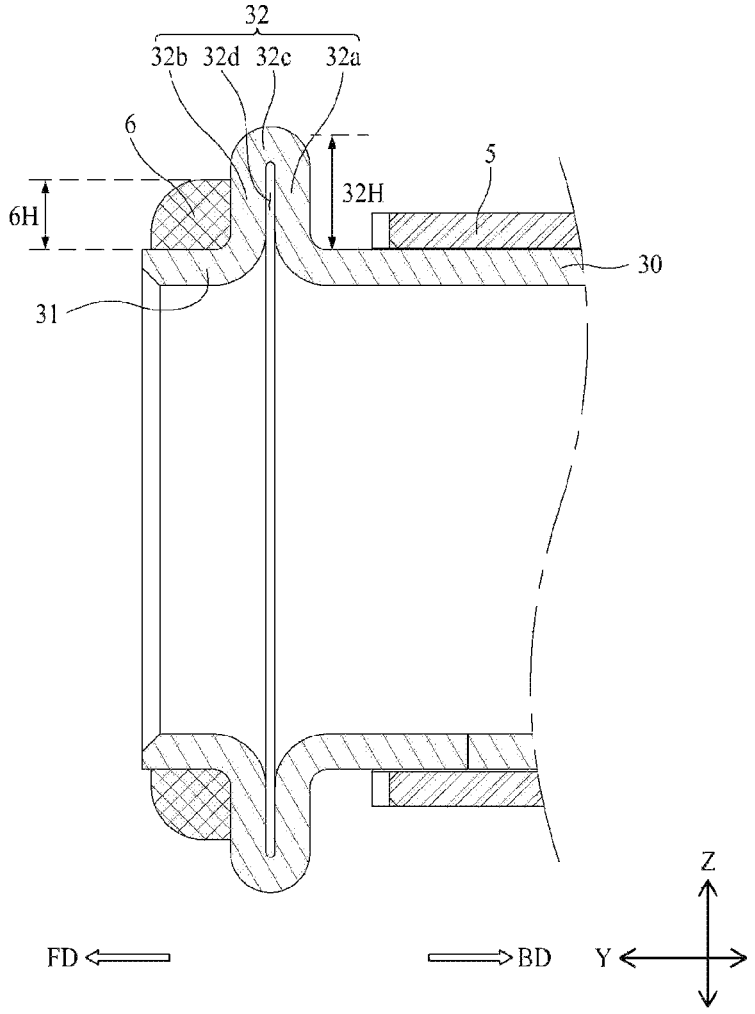

[Fig. 10]
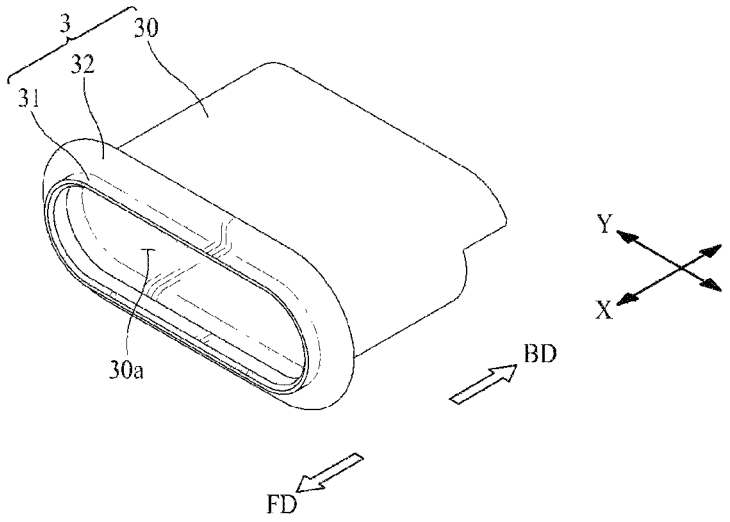
[Fig. 11]
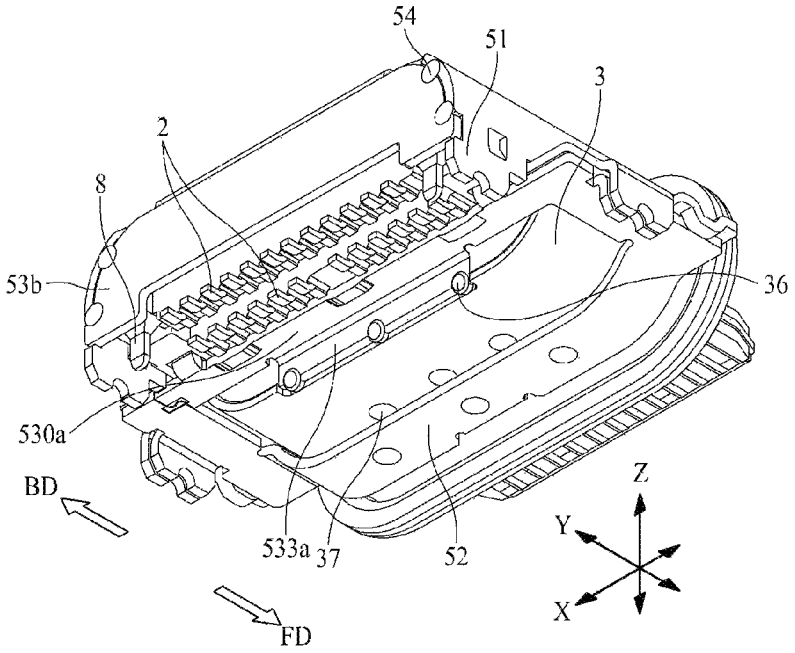

[Fig. 12]
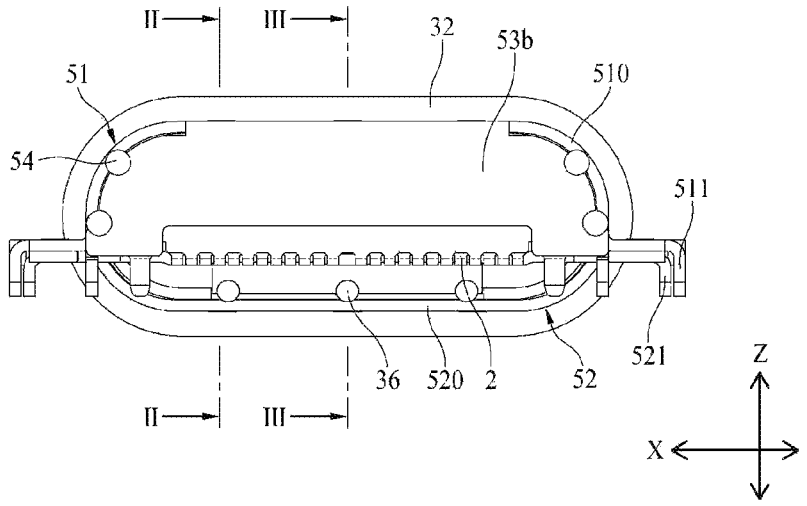
[Fig. 13]
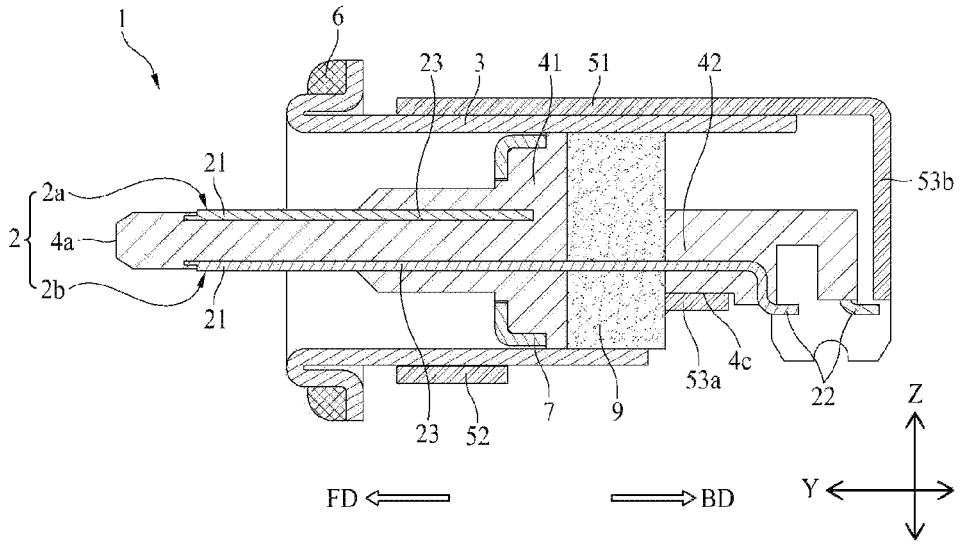

[Fig. 14]
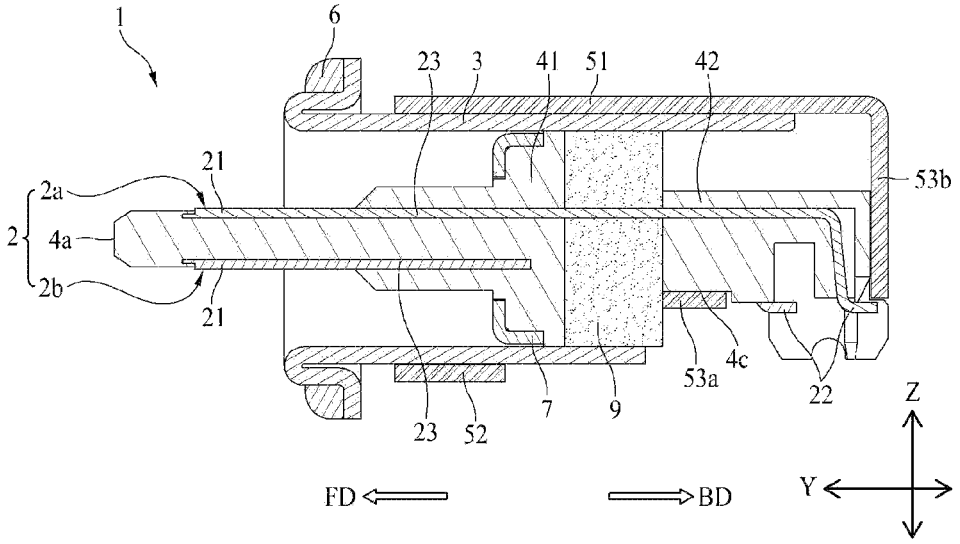
[Fig. 15]
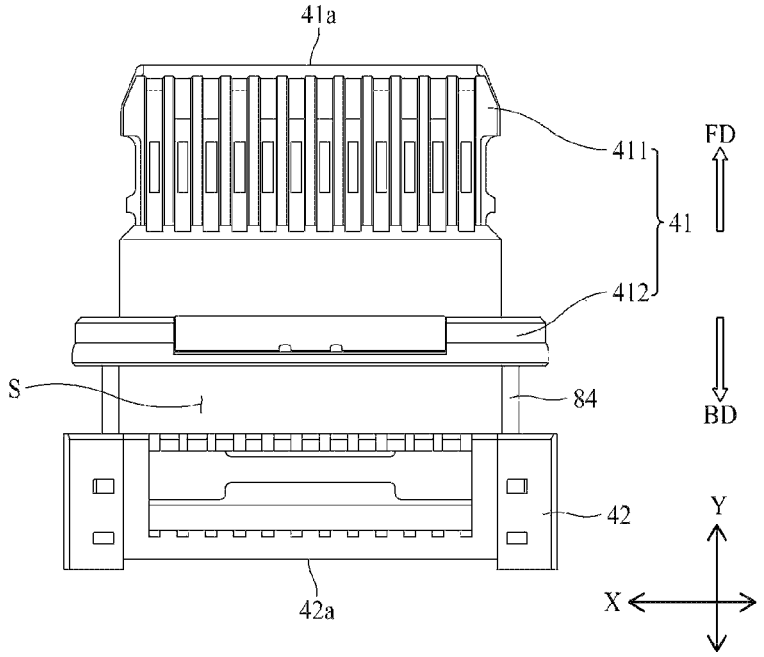

[Fig. 16]
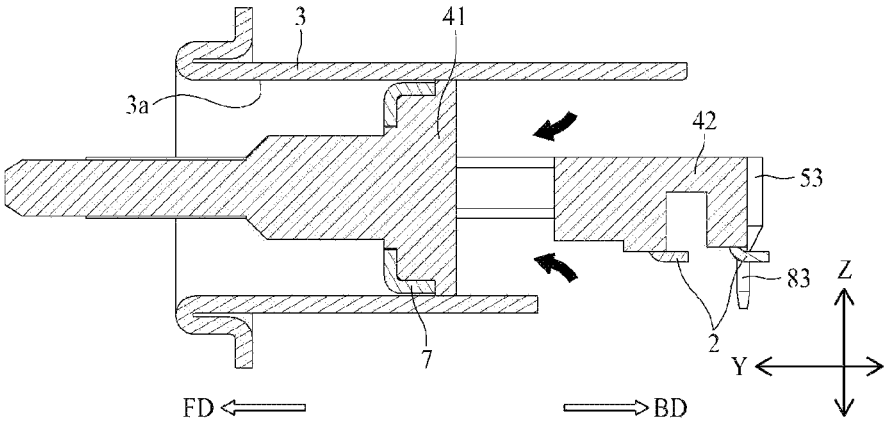
[Fig. 17]
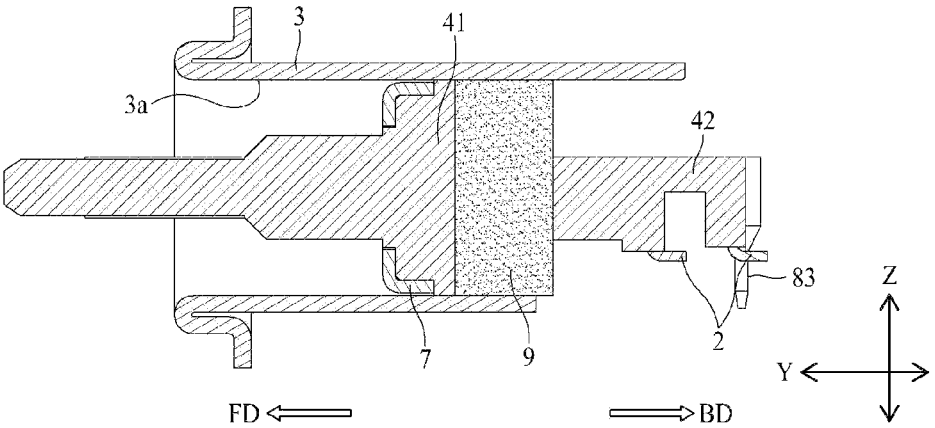

[Fig. 18a]
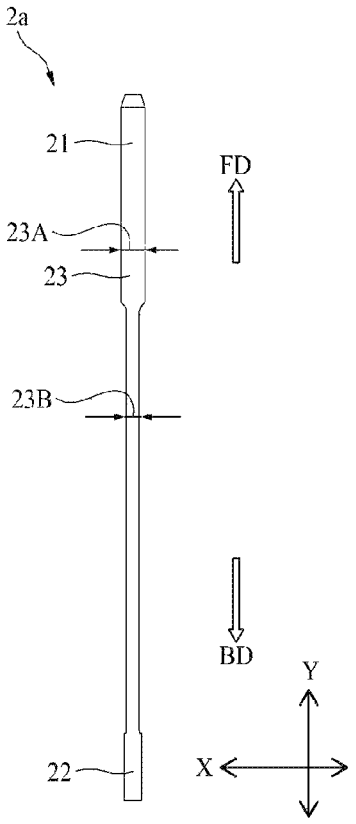
[Fig. 18b]
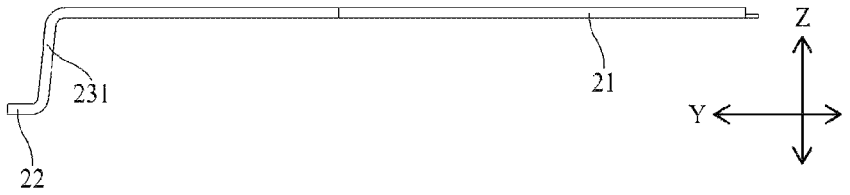

[Fig. 19a]
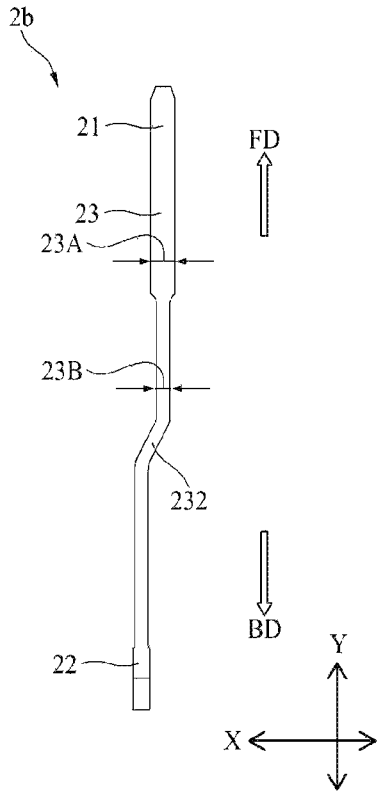
[Fig. 19b]
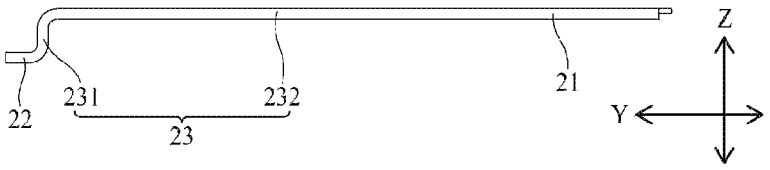

[Fig. 20]
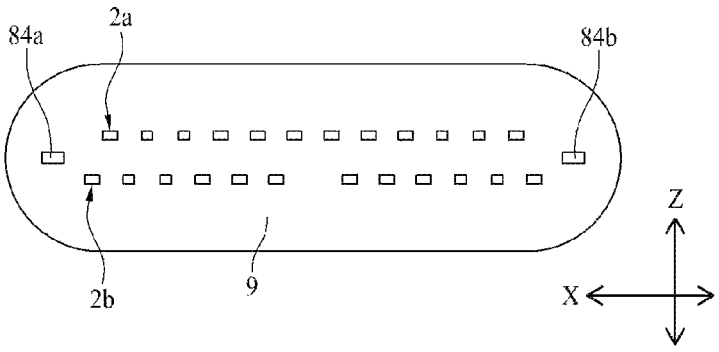
[Fig. 21]
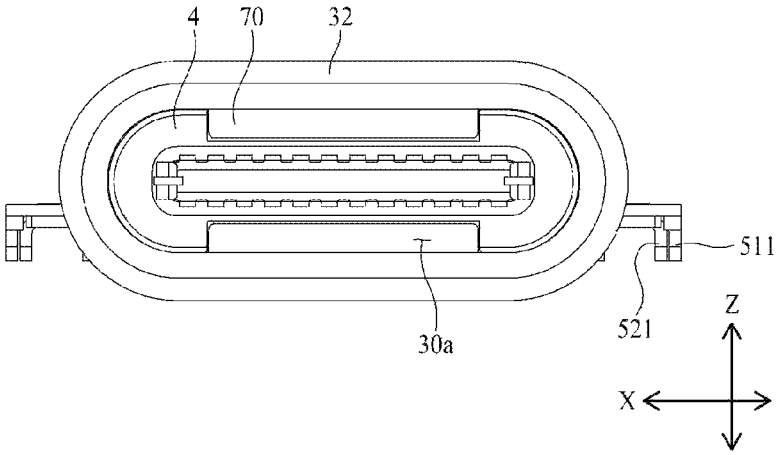

[Fig. 22]
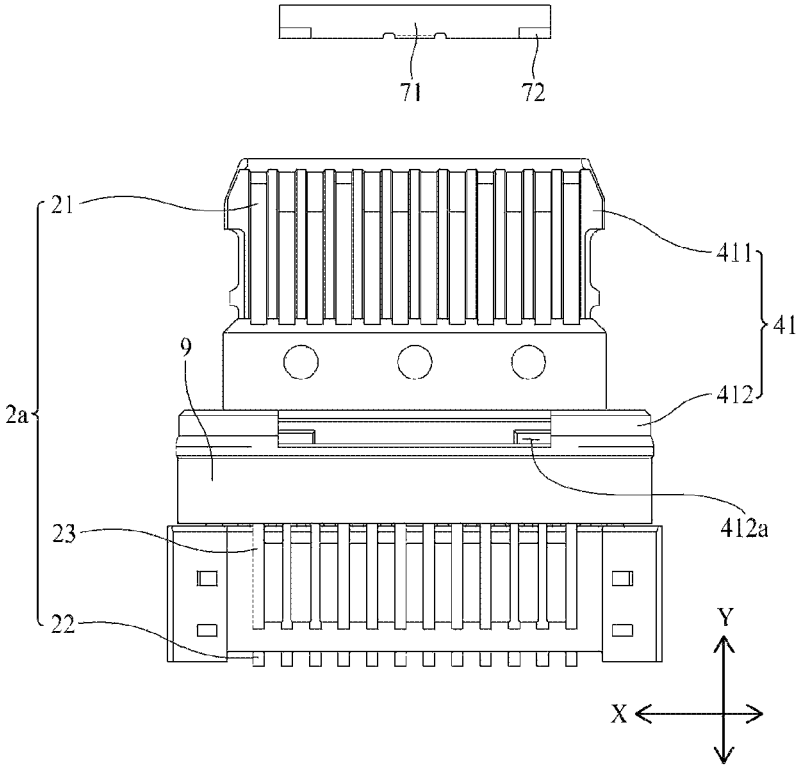

RECEPTACLE CONNECTOR

CROSS-REFERENCE TO RELATED APPLICATIONS

The present application is a National Stage of International Application No. PCT/KR2018/014791, filed Nov. 28, 2018, the disclosure of which is incorporated herein by reference.

FIELD OF THE INVENTION

The present invention relates to a receptacle connector coupled to an electronic device for connection with a plug connector.

BACKGROUND OF THE INVENTION

Generally, receptacle connectors are coupled to substrates provided in a variety of electronic devices for connection with corresponding plug connectors. For example, a receptacle connector may be installed in electronic devices such as a portable computer, a cellular phone, and the like and used to perform a charging function, a data transmission function, and the like.

As electronic devices have been required recently to be equipped with further reinforced waterproof performance than daily waterproof performance, development of receptacle connectors having reinforced waterproof performance has been vigorously performed.

Meanwhile, although waterproof performance with respect to each of a receptacle connector and an electronic device is reinforced, overall waterproof performance is degraded due to a gap generated between the receptacle connector and the electronic device while the receptacle connector is coupled to the electronic device.

Also, recently, with respect to electronic devices to which receptacle connectors are applied, it has been required that electronic devices have high performance and be implemented with miniaturization. As part of this, depending on an electronic device to which a receptacle connector is applied, a request for high-speed transmission of signals occurs to the receptacle connector.

However, a receptacle connector according to a related art has a problem of degrading performance of another device provided in an electronic device, to which the receptacle connector is applied, as well as degrading signal transmission performance due to occurrence of emission with respect to signals while signals are transmitted. For example, when the receptacle connector according to the related art is applied to a cellular phone, performance of an antenna provided in the cellular phone may be degraded. This problem becomes more intensified when the receptacle connector according to the related art is configured to perform high-speed transmission of signals.

BRIEF SUMMARY OF THE INVENTION

The present invention is directed to providing a receptacle connector allowing waterproof performance to be prevented from being degraded due to a gap occurring between the receptacle connector and an electronic device.

The present invention is directed to providing a receptacle connector allowing occurrence of emission of signals to be reduced.

To solve the above problems, the present invention may include the following components.

One aspect of the present invention provides a receptacle connector including a plurality of contacts configured to electrically connect a plug connector to a substrate, an insulation portion to which the contacts are coupled, a shell to which the insulation portion is coupled, a cover to which the shell is coupled, and a sealing member coupled to the shell to seal a space between the electronic device and the shell.

The shell may include a shell body to which the cover is coupled, a support member to which the sealing member is coupled, and a support protrusion integrally formed with the support member, and the support member is coupled to the cover to protrude from the cover in a forward direction and to be located outside the cover.

The support protrusion may be formed on the support member to protrude from the support member in an outward direction and to restrict a movable distance of the sealing member in a backward direction.

The support member may be formed to have a thickness greater than that of the shell body.

Another aspect of the present invention provides a receptacle connector, in which the support member may be formed to have a thickness equal to that of the shell body.

According to the present invention, the following effects may be promoted.

According to the present invention, since a waterproofing function with respect to a gap from an electronic device may be implemented by sealing a space between an outer surface of a shell and the electronic device, overall waterproof performance with respect to the electronic device can be reinforced.

According to the present invention, since it is possible to prevent a sealing member from being detached due to vibrations, shaking, and the like which occur during a process of inserting a plug connector, a process of using an electronic device and the like by restricting a movable distance of the sealing member in a backward direction, the sealing member may be implemented to firmly maintain a state of sealing a space between the shell and the electronic device.

Since the present invention is implemented to reduce occurrence of emission of signals while signals are transmitted, not only signal transmission performance may be improved but also a degree of degradation in performance of another device provided in an electronic device, to which the present invention is applied, which occurs due to an emitted signal may be reduced.

According to the present invention, since a plurality of insulation portions spaced apart from each other are included and the plurality of insulation portions are connected using a mid plate formed of a material having a great bonding force to a waterproof portion, it is possible to block water permeating through a gap between the mid plate and the waterproof portion.

BRIEF DESCRIPTION OF THE DRAWINGS

FIG. 1 is a schematic perspective view of a receptacle connector according to the present invention.

FIG. 2 is a schematic exploded perspective view of the receptacle connector according to the present invention.

FIG. 3 is a partial schematic cross-sectional view illustrating the receptacle connector taken along line I-I of FIG. 1 according to one embodiment of the present invention.

FIG. 4 is a schematic perspective view illustrating a shell of the receptacle connector according to one embodiment of the present invention.

FIG. 5 is a partial bottom view illustrating a shell body with a seam present therein.

FIG. 6 is a schematic perspective view illustrating the shell of the receptacle connector according to the present invention.

FIG. 7 is a schematic perspective view illustrating the shell of the receptacle connector according to the present invention when viewed in a direction different from that of FIG. 6.

FIG. 8 is a concept view illustrating a method of forming the shell of the receptacle connector according to the present invention.

FIG. 9 is a partial schematic cross-sectional view illustrating the receptacle connector taken along line I-I of FIG. 1 according to another embodiment of the present invention.

FIG. 10 is a schematic perspective view illustrating a shell of a receptacle connector according to another embodiment of the present invention.

FIG. 11 is a schematic rear perspective view of the receptacle connector according to the present invention.

FIG. 12 is a schematic rear view of the receptacle connector according to the present invention.

FIG. 13 is a schematic cross-sectional view illustrating the receptacle connector according to the present invention taken along line II-II of FIG. 12.

FIG. 14 is a schematic cross-sectional view illustrating the receptacle connector according to the present invention taken along line of FIG. 12.

FIG. 15 is a schematic plan view illustrating an insulation portion of the receptacle connector according to the present invention, to which contacts and a mid-plate are coupled.

FIGS. 16 and 17 are schematic side cross-sectional views illustrating the insulation portion to which the contacts are coupled for describing a process of forming a waterproof portion in the receptacle connector according to the present invention.

FIGS. 18A and 18B are a schematic plan view and a side view illustrating one example of a first contact of the receptacle connector according to the present invention.

FIGS. 19A and 19B are a schematic plan view and a side view illustrating one example of a second contact of the receptacle connector according to the present invention.

FIG. 20 is a schematic cross-sectional view illustrating the contact and the insulation portion of the receptacle connector according to the present invention.

FIG. 21 is a schematic front view of the receptacle connector according to the present invention.

FIG. 22 is a schematic exploded plan view illustrating a restriction member and the insulation portion of the receptacle connector according to the present invention.

DETAILED DESCRIPTION OF THE INVENTION

Hereinafter, embodiments with respect to a receptacle connector according to the present invention will be described in detail with reference to the attached drawings.

Referring to FIGS. 1 to 4, a receptacle connector 1 according to the present invention is coupled to a substrate (not shown) provided in a variety of electronic devices for connection with a plug connector. The substrate may be a printed circuit board (PCB).

The receptacle connector 1 according to the present invention may include a plurality of contacts 2, a shell 3, an insulation portion 4, a cover 5, and a sealing member 6.

The contacts 2 are configured to electrically connect the plug connector to the substrate. The contacts 2 may be connected to the plug connector while being mounted on the substrate so as to electrically connect the substrate to the plug connector. The shell 3 is a part to which the insulation portion 4 is coupled. The insulation portion 4 is a part to which the contacts 2 are coupled. The insulation portion 4 may be coupled to the shell 3 to be located inside the shell 3 while the contacts 2 are coupled thereto. The cover 5 is configured to be coupled to the shell 3. The cover 5 may be coupled to the shell 3 to be located outside the shell 3 to which the insulation portion 4 is coupled.

The shell 3 may include a support member 31 (refer to FIG. 3). The support member 31 is configured to support the sealing member 6 (refer to FIG. 3) which performs a waterproofing function. The shell 3 may be coupled to the cover 5 such that the support member 31 protrudes forward (in an FD arrow direction shown in FIG. 3) from the cover 5 and is located outside the cover 5. Accordingly, the support member 31 may support the sealing member 6 such that the sealing member 6 seals a gap between the shell 3 and the electronic device from the outside of the cover 5.

The shell 3 may include a support protrusion 32 (refer to FIG. 3). The support protrusion 32 is configured to restrict a movable distance of the sealing member 6. The support protrusion 32 may protrude outward from the support member 31 so as to restrict a movable distance of the sealing member 6 in a backward direction (BD arrow direction shown in FIG. 3). Accordingly, the support protrusion 32 may restrict the movable distance of the sealing member 6 in the backward direction (BD arrow direction) by supporting the sealing member 6 to the rear of the sealing member 6.

Accordingly, the receptacle connector 1 according to the present invention may promote performance effects as follows.

First, the receptacle connector 1 according to the present invention may be implemented to seal the gap between the shell 3 and the electronic device using the sealing member 6 coupled to the support member 31. Accordingly, a waterproofing function with respect to a gap between the receptacle connector 1 according to the present invention and the electronic device may be implemented. Accordingly, the receptacle connector 1 according to the present invention may improve overall waterproof performance with respect to the electronic device.

Second, the receptacle connector 1 according to the present invention is implemented to restrict the movable distance of the sealing member 6 in the backward direction (BD arrow direction) using the support protrusion 32. Accordingly, the receptacle connector 1 according to the present invention may prevent the sealing member 6 coupled to the support protrusion 32 from being separated therefrom due to vibrations, shaking, and the like which occur during a process of inserting the plug connector, a process of using the electronic device, and the like. Accordingly, the receptacle connector 1 according to the present invention may be implemented to firmly maintain a state in which the sealing member 6 coupled with the support protrusion 32 seals the gap between the shell 3 and the electronic device.

Hereinafter, the contacts 2, the shell 3, the insulation portion 4, the cover 5, and the sealing member 6 will be described in detail with reference to the attached drawings.

The contacts 2 are connected to the plug connector inserted in the shell 3 while being mounted on the substrate so as to electrically connect the plug connector to the substrate. The contacts 2 may be connected to the plug connector while being mounted on the substrate so as to electrically connect the plug connector to the substrate. The contacts 2 may be formed of a conductive material. The plug connector may be inserted into an insertion groove 30*a* (refer to FIG. 1) of the shell 3 to be connected to the contacts 2.

The contacts 2 may be installed on the insulation portion 4. The plurality of contacts 2 may be installed on the insulation portion 4. The contacts 2 may be installed on the insulation portion 4 to be spaced apart in a first axial direction (X-axis direction shown in FIG. 2). The contacts 2 may each include a connection member 21 (refer to 2) and a mounting member 22 (refer to FIG. 2).

The connection member 21 is configured to be connected to the plug connector. The contacts 2 may be installed on the insulation portion 4 such that the connection members 21 are supported by the insulation portion 4.

The mounting members 22 are configured to be mounted on the substrate. The mounting members 22 are mounted on the substrate and electrically connected to the substrate. Accordingly, the plug connector connected to the connection members 21 may be electrically connected to the substrate through the mounting members 22. The contacts 2 may be installed on the insulation portion 4 such that the mounting members 22 are located outside the insulation portion 4. The contacts 2 may be installed on the insulation portion 4 such that the mounting members 22 are arranged to be parallel to the substrate.

The contacts 2 may each include a connecting member 23 (refer to FIG. 2).

The connecting member 23 is configured to connect the connection member 21 to the mounting member 22. The connecting member 23 is located between the connection member 21 and the mounting member 22. One side of the connecting member 23 may be coupled to the connection member 21, and the other side thereof may be coupled to the mounting member 22. The connecting member 23, the mounting member 22, and the connection member 21 may be integrally formed.

Referring to FIG. 2, the contacts 2 may include contacts having the connection member 21 located on a top surface of the insulation portion 4 (hereinafter, referred to as first contacts 2*a*) and contacts having the connection member 21 located on a bottom surface of the insulation portion 4 (hereinafter, referred to as second contacts 2*b*). The first contacts 2*a* may be installed on the insulation portion 4 such that the connection members 21 are spaced apart on the top surface of the insulation portion 4 along the first axial direction (X-axis direction). The second contacts 2*b* may be installed on the insulation portion 4 such that the connection members 21 are spaced apart on the bottom surface of the insulation portion 4 along the first axial direction (X-axis direction). Accordingly, the insulation portion 4 may be disposed to be located between the connection members 21 of the first contacts 2*a* and the connection members 21 of the second contacts 2*b*. Accordingly, the insulation portion 4 may insulate so as to prevent the connection members 21 of the first contacts 2*a* and the connection members 21 of the second contacts 2*b* from coming into contact with each other. The first contacts 2*a* and the second contacts 2*b* may be installed on the insulation portion 4 through insert molding.

The mounting members 22 of the first contacts 2*a* and the mounting members 22 of the second contacts 2*b* may be mounted on the substrate at positions spaced apart from each other in a second axial direction (Y-axis direction shown in FIG. 2). The second axial direction (Y-axis direction) is perpendicular to the first axial direction (x-axis direction).

According to a comparative example in which the mounting members 22 of the first contacts 2*a* and the mounting members 22 of the second contacts 2*b* are mounted on the substrate at the same positions on the basis of the second axial direction (Y-axis direction), since it is necessary to arrange the mounting members 22 to be spaced at certain intervals apart along the first axial direction (X-axis direction) to prevent a short circuit between the mounting members 22, it may be difficult to implement miniaturization.

Accordingly, since the receptacle connector 1 according to the present invention is implemented such that the mounting members 22 of the first contacts 2*a* and the mounting members 22 of the second contacts 2*b* are mounted on the substrate at different positions on the basis of the second axial direction (Y-axis direction), it is possible to implement miniaturization.

The shell 3 is a part to which the insulation portion 4 is coupled. The shell 3 may provide a connection space in which the plug connector is connected to the contacts 2. The plug connector may move from the forward direction (the FD arrow direction) to the backward direction (the BD arrow direction) of the shell 3 and be inserted into the shell 3 so as to be connected to the contacts 2. The plug connector may move in the forward direction (the FD arrow direction) and be detached from the shell 3 so as to be separated from the contacts 2.

The shell 3 may support the insulation portion 4. The insulation portion 4 may move from the rearward direction (the BD arrow direction) of the shell 3 to the forward direction (FD arrow direction) while the contacts 2 are coupled so as to be inserted into the shell 3.

The shell 3 may be coupled to the cover 5. The shell 3 may be coupled to the cover 5 to be partially located inside the cover 5. The cover 5 may be coupled to a shell body 30 (refer to FIG. 3) of the shell 3. The shell body 30 is a part of the shell 3 which is located inside the cover 5. The insulation portion 4 to which the contacts 2 are coupled may be located inside the shell body 30. The shell body 30 may be formed to have an overall hollow elliptical oblong shape but is not limited thereto, and any other shapes capable of protecting the contacts 2 and the insulation portion 4 from the outside are applicable.

Referring to FIGS. 5 to 8, the shell body 30 is integrally formed not to have a seam 34 (refer to FIG. 5). Accordingly, an outer surface of the shell 3 is implemented without a gap caused by the seam 34. Accordingly, the receptacle connector 1 according to the present invention may promote performance effects as follows.

First, when the shell 3 is manufactured through a bending process of cutting and bending a panel and a coupling process of coupling both ends of the bent panel using a welding operation and the like, the seam 34 is formed on the shell 3 through the coupling process. Since the seam 34 is a gap, it is necessary to fill the gap through an additional operation such as tapping or the like in implementing a waterproofing function. Accordingly, a manufacturing cost of the shell 3 is increased by an increase in number of operations and productivity thereof is decreased by an increase in manufacturing time. Also, even when the seam 34 of the shell 3 is filled through the additional operation, a risk of permeation of water and the like through the seam 34 is still present such that waterproof performance is decreased.

On the other hand, in the receptacle connector 1 according to the present invention, the shell body 30 is integrally formed not to have the seam 34 such that the outer surface of the shell 3 is implemented without a gap caused by the seam 34. Accordingly, the receptacle connector 1 according to the present invention is implemented such that the shell 3 has a waterproofing function without an additional operation such as tapping and the like for filling the seam 34. Accordingly, the receptacle connector 1 according to the present invention may reduce manufacturing costs by reducing the number of operations and by being equipped with a waterproofing function and increase productivity by reducing manufacturing time.

Also, in the receptacle connector 1 according to the present invention, since the shell body 30 is integrally formed without the seam 34 such that the outer surface of the shell 3 is implemented without a gap caused by the seam 34, it is possible to fundamentally prevent a possibility of permeation of water and the like through the seam 34. Accordingly, the receptacle connector 1 according to the present invention may improve waterproof performance.

The shell body 30 may be integrally formed to have no seam 34 by processing a panel using a deep drawing method. In this case, the shell body 30 may be integrally formed without the seam 34 through the following process.

First, as shown in FIG. 8, while a processing device 200 comes into contact with one surface of a panel 100, the processing device 200 moves downward to a position spaced at a certain distance from the other surface of the panel 100 such that a processing portion 300 is formed in the panel 100. The processing device 200 may be a puncher provided in press equipment. The processing device 200 is formed to have a shape corresponding to the shell body 30. The panel 100 may be in a state of being supported by dies of the press equipment.

Next, when the processing portion 300 is formed by the processing device 200 to have one end which is closed and the other end which is open, a part of the one side of the processing portion 300 is cut. Accordingly, the processing portion 300 is formed to have both ends which are open so as to be manufactured as the shell body 30. In this case, a process of cutting a part of the other side of the processing portion 300 may be performed.

Through the above-described processes, the shell body 30 may be integrally formed without the seam 34 as shown in FIGS. 6 and 7. Accordingly, the receptacle connector 1 according to the present invention may reduce manufacturing costs by reducing the number of operations and by being equipped with a waterproofing function and increase productivity by reducing manufacturing time. Also, since the receptacle connector 1 according to the present invention is capable of fundamentally preventing a possibility of water and the like permeating through the seam 34, waterproof performance may be reinforced.

Although not shown in the drawings, the shell body 30 may be integrally formed using another method in addition to the above-described deep drawing method. For example, the shell body 30 may be integrally formed to be processed using a method such as a tube forming method, a die casting method, a metal injection molding (MIM) method, and the like.

The insertion groove 30*a* is formed to pass through the shell body 30. The insertion groove 30*a* may function as a connection space in which the plug connector is connected to the contacts 2. The plug connector may move from the forward direction (the FD arrow direction) to the rearward direction (the BD arrow direction) of the shell 3 and be inserted into the insertion groove 30*a* so as to be connected to the contacts 2 located in the insertion groove 30*a*. The insertion groove 30*a* may be formed through an operation of processing the panel 100 using a deep drawing method.

The shell 3 may include the support member 31 and the support protrusion 32.

The support member 31 is a part to which the sealing member 6 is coupled. The shell 3 may be coupled to the cover 5 such that the support member 31 protrudes from the cover 5 in the forward direction (FD arrow direction) and is located outside the cover 5. Accordingly, the sealing member 6 coupled to the support member 31 comes into contact with the electronic device from the outside of the cover 5 so as to seal a space between the outer surface of the shell 3 and the electronic device. Accordingly, a waterproofing function with respect to a gap between the receptacle connector 1 according to the present invention and the electronic device may be implemented so as to reinforce overall waterproof performance with respect to the electronic device. For example, the sealing member 6 coupled to the support member 31 comes into contact with a frame (not shown) of the electronic device so as to seal a space between the outer surface of the shell 3 and the frame. The frame may be a case of the electronic device.

The support member 31 may be coupled to the shell body 30 to protrude from the shell body 30 in the forward direction (FD arrow direction). The shell 3 may be coupled to the cover 5 such that the support member 31 is located outside the cover 5 and the shell body 30 is located inside the cover 5. The insulation portion 4 to which the contacts 2 are coupled may be coupled to the shell 3 to be located inside the support member 31 and inside the shell body 30. The insertion groove 30*a* may be formed to pass through both the support member 31 and the shell body 30. The support member 31 may be formed to have an overall hollow elliptical oblong shape but is not limited thereto, and any other shapes capable of protecting the contacts 2 and the insulation portion 4 from the outside are applicable. The support member 31 and the shell body 30 may be integrally formed.

The support member 31 may be formed to have a length longer than that of the sealing member 6 to be located in the forward direction (FD arrow direction) of the sealing member 6. For example, the support member 31 may be formed to be longer than the sealing member 6 on the basis of the second axial direction (Y-axis direction). Accordingly, an end of the support member 31 may be located in the forward direction (FD arrow direction) of the sealing member 6. Accordingly, the receptacle connector 1 according to the present invention may prevent the sealing member 6 coupled to the support member 31 from being separated therefrom due to vibrations, shaking, and the like which occur during a process of inserting or separating the plug connector, a process of using the electronic device, and the like. Such effects will be described in detail as follows.

According to a comparative example in which the support member 31 is formed to have a length equal to or smaller than that of the sealing member 6 on the basis of the second axial direction (Y-axis direction) such the end of the support member 31 coincides with the sealing member 6 or is located in the backward direction (BD arrow direction) of the sealing member 6, the sealing member 6 may be detached from the support member 31 during a process of inserting or separating the plug connector or the like. Accordingly, the receptacle connector 1 according to the present invention may be implemented to firmly maintain a state in which the support member 31 is formed to be longer than the sealing member 6 such that the sealing member 6 coupled to the support protrusion 32 seals a space between the shell 3 and the electronic device.

The support protrusion 32 is formed on the support member 31. The shell 3 may be coupled to the cover 5 such that the support protrusion 32 protrudes from the cover 5 in the forward direction (FD arrow direction) and is located outside the cover 5. The support protrusion 32 may support the sealing member 6 in the backward direction (BD arrow direction) of the sealing member 6. Accordingly, the support protrusion 32 may restrict the movable distance of the sealing member 6 in the backward direction (BD arrow direction) by supporting the sealing member 6 in the backward direction (BD arrow direction) of the sealing member 6. Accordingly, the receptacle connector 1 according to the present invention may be implemented to firmly maintain a state in which the sealing member 6 seals the gap between the shell 3 and the electronic device by preventing the sealing member 6 from being separated due to vibrations, shaking, and the like which occur in the process of inserting or separating the plug connector, the process of using the electromagnetic device, and the like.

The support protrusion 32 may be formed on an outer surface of the support member 31. The support protrusion 32 may be formed to protrude outward from the support member 31. Accordingly, the receptacle connector 1 according to the present invention may form a sectional thickness T of the sealing member 6 as thick as a height of the support protrusion 32 protruding from the support member 31. The support protrusion 32 may be formed on the outer surface of the support member 31 along a circumferential direction of the support member 31. The support protrusion 32 may be formed to have an overall elliptical ring shape but is not limited thereto and may be formed to have any shape capable of supporting the sealing member 6.

The support protrusion 32 may be formed to protrude outward from the support member 31 to come into contact with the frame of the electronic device and to seal a gap between the outer surface of the shell 3 and the frame. When an insertion hole into which the support protrusion 32 is inserted is formed in the frame, a size of the support protrusion 32 may be implemented to be equal to a size of the insertion hole. Accordingly, the support protrusion 32 is inserted into the insertion hole and pressed against the frame so as to seal the gap between the outer surface of the shell 3 and the frame. The size of the support protrusion 32 may be implemented to be greater than the size of the insertion hole. In this case, the support protrusion 32 may be fixed to the frame using an interference fitting method so as to further increase a sealing force between the outer surface of the shell 3 and the frame.

The support protrusion 32 may be formed on the support member 31 to protrude further outward from the support member 31 in comparison to the sealing member 6. That is, on the basis of a third axial direction (Z-axis direction), a length 32H of the support protrusion 32 protruding from the support member 31 is formed to be longer than a length 6H of the sealing member 6 coupled to the support member 31. Accordingly, the receptacle connector 1 according to the present invention may prevent the sealing member 6 from being separated from the support protrusion 32 and moving in the backward direction (BD arrow direction) of the support protrusion 32 during a process of inserting the plug connector. However, the present invention is not limited thereto, and the support protrusion 32 may be formed to protrude outward from the support member 31 by as much as a length of the sealing member 6 protruding outward from the support member 31. The support protrusion 32, the support member 31, and the shell body 30 may be integrally formed.

The insulation portion 4 is configured to support the contacts 2. The insulation portion 4 may be installed in the shell 3 such that a front surface 4*a* (refer to FIG. 1) protrudes from the insertion groove 30*a* in the forward direction (FD arrow direction). The front surface 4*a* of the insulation portion 4 is shown in FIG. 1 as protruding from the insertion groove 30*a* in the forward direction (FD arrow direction) but is not limited thereto and may be located in the insertion groove 30*a*.

The insulation portion 4 may be installed in the shell 3 to be located inside the shell 3. The insulation portion 4 may be installed in the shell 3 such that the front surface 4*a* protrudes from the insertion groove 30*a*. The insulation portion 4 may be installed in the shell 3 such that a rear surface 4*b* protrudes from the insertion groove 30*a*. The plug connector may be inserted into the shell 3 through the insertion groove 30*a* so as to be connected to the connection members 21 installed on the insulation portion 4. The mounting members 22 of the first contacts 2*a* and the mounting members 22 of the second contacts 2*b* may be supported by the insulation portion 4 protruding from the insertion groove 30*a* so as to be mounted on the substrate outside the insertion groove 30*a*.

The cover 5 is configured to protect the shell 3. The shell 3 may be coupled with the cover 5 to be located inside the cover 5. The cover 5 may be coupled and fixed to the substrate. The cover 5 may be mounted on the substrate using a surface mount technology to be coupled to be fixed to the substrate. The cover 5 and the shell 3 may be coupled by performing partial welding thereon.

The sealing member 6 is configured to implement a waterproofing function. The sealing member 6 may be installed on the shell 3. When the receptacle connector 1 according to the present invention is installed on the electronic device, the sealing member 6 may be pressed against the frame of the electronic device so as to block permeation of water, dust, and the like. Accordingly, even in a relationship with the electronic device, the receptacle connector 1 according to the present invention may be implemented to have a waterproofing function so as to contribute to improving waterproof performance with respect to the electronic device. The sealing member 6 may be installed on the shell 3 to surround the outer surface of the shell 3.

Referring to FIGS. 3 and 4, the support member 31 may be formed to have a thickness greater than that of the shell body 30. That is, the support member 31 may be formed to have a length formed along the third axial direction (Z-axis direction) which is longer than that of the shell body 30. In this case, the support member 31 may include a first support member 31*a* (refer to FIG. 3) and a second support member 31*b* (refer to FIG. 3).

The first support member 31*a* may be formed to extend from the shell body 30. The first support member 31*a* may be formed to extend from the shell body 30 in the forward direction (FD arrow direction). The first support member 31*a* may support the second support member 31*b* from inside the second support member 31*b*.

The second support member 31*b* may support the sealing member 6. The second support member 31*b* may support the sealing member 6 from the outside of the first support member 31*a*. The sealing member 6 may be supported by the second support member 31*b* from the outside of the second support member 31*b*. In this case, the second support member 31*b* may be disposed between the sealing member 6 and the first support member 31*a* on the basis of the third axial direction (Z-axis direction). Accordingly, the receptacle connector 1 according to the present invention may implement a double support structure with respect to the sealing member 6 using the second support member 31*b* and the first support member 31*a*. Accordingly, the receptacle connector 1 according to the present invention may further reinforce waterproof performance using the sealing member 6 by reinforcing a support force with respect to the sealing member 6.

The second support member 31*b* and the first support member 31*a* may be disposed to be spaced apart from each other. In this case, the second support member 31*b* may be disposed to the outside of the first support member 31*a* to be spaced apart from the first support member 31*a*. For example, the second support member 31*b* and the first support member 31*a* may be disposed to be spaced apart from each other on the basis of the third direction (Z-axis direction). As the second support member 31*b* and the first support member 31*a* are disposed to be spaced apart from each other, a separation groove 31*d* (refer to FIG. 3) may be disposed between the second support member 31*b* and the first support member 31*a*. Due to the separation groove 31*d*, a space in which the second support member 31*b* is movable toward the first support member 31*a* may be secured. Accordingly, in the receptacle connector 1 according to the present invention, when an external force is applied to the sealing member 6 supported by the second support member 31*b*, the second support member 31*b* may move toward the first support member 31*a* through the separation groove 31*d* so as to relieve an impact and the like caused by the external force applied to the sealing member 6. Accordingly, the receptacle connector 1 according to the present invention may reduce degradation in waterproof performance using the sealing member 6 which occurs due to the external force applied to the sealing member 6.

The support member 31 may include a connection support member 31*c* (refer to FIG. 3).

The connection support member 31*c* is configured to connect the first support member 31*a* to the second support member 31*b*. The connection support member 31*c* may be coupled with each of the first support member 31*a* and the second support member 31*b* so as to connect the first support member 31*a* to the second support member 31*b*. The connection support member 31*c* may be formed in the third axial direction (Z-axis direction) so as to connect the first support member 31*a* to the second support member 31*b*. Accordingly, the second support member 31*b* may support the sealing member 6 from the outside of the first support member 31*a*. The support protrusion 32 may be formed on the second support member 31*b* to protrude outward from one end of the second support member 31*b* which is not connected to the connection support member 31*c*.

The connection support member 31*c*, the second support member 31*b*, and the first support member 31*a* may be integrally formed. In this case, the support member 31 may be formed to include the connection support member 31*c*, the second support member 31*b*, and the first support member 31*a* by bending a panel. Accordingly, the connection support member 31*c* may be formed such that a surface, which faces the forward direction (FD arrow direction), forms a curve.

Also, as described above, the shell body 30, the support member 31, and the support protrusion 32 may be integrally formed. In this case, the shell 3 may be formed to include the support member 31 including the connection support member 31*c*, the second support member 31*b*, and the first support member 31*a*, the shell body 30, and the support protrusion 32 by bending a panel. A process of integrally forming the shell body 30, the support member 31, and the support protrusion 32 will be described in brief as follows.

As described above with reference to FIGS. 5 to 8, the shell 3 may be integrally formed not to have a gap caused by the seam 34 on the outer surface. Subsequently, the support member 31 including the first support member 31*a* connected to the shell body 30, the connection support member 31*c* connected to the first support member 31*a*, and the second support member 31*b* connected to the connection support member 31*c* may be formed by primarily bending the shell 3. Also, the support protrusion 32 having one end connected to the second support member 31*b* may be formed by secondarily bending the shell 3.

Accordingly, since it is possible to form a structure configured to reduce the number of operations as well as support the sealing member 6, the receptacle connector 1 according to the present invention may reduce manufacturing costs and increase productivity by reducing a manufacturing time in comparison to a comparative example of separately forming the support member 31 and the support protrusion 32 on the shell body 30.

Also, the receptacle connector 1 according to the present invention may prevent a size of the shell body 30 from being increased by forming the support member 31 and the support protrusion 32 by bending an end of the panel. Accordingly, in comparison to a comparative example of forming a step between the support member 31 and the shell body 30 by increasing a thickness of the shell body 30 to support the sealing member 6, the receptacle connector 1 according to the present invention has an advantage of implementing miniaturization.

In the embodiment, the support member 31 and the support protrusion 32 are formed by bending ends of the panel such that the support member 31 is formed to have a thickness greater than that of the shell body 30. However, the present invention is not limited thereto.

For example, referring to FIGS. 9 and 10, the receptacle connector 1 according to another embodiment of the present invention may be formed so that the support member 31 has the same thickness as that of the shell body 30. In this case, the support protrusion 32 may include a first support protrusion 32*a* (refer to FIG. 9) and a second support protrusion 32*b* (refer to FIG. 9).

The first support protrusion 32*a* may be formed to extend from the shell body 30. The first support protrusion 32*a* may be formed to protrude outward from the shell body 30. The first support protrusion 32*a* may support the second support protrusion 32*b* in the backward direction (BD arrow direction) from the second support protrusion 32*b*.

The second support protrusion 32*b* is formed in front of the first support protrusion 32*a*. The second support protrusion 32*b* may be disposed to be parallel to the first support protrusion 32*a* to restrict the movable distance of the sealing member 6 in the backward direction (BD arrow direction). Accordingly, in comparison to a comparative example of restricting movement of the sealing member 6 using only the first support protrusion 32*a* or the second support protrusion 32*b*, the receptacle connector 1 according to the present invention may more stably restrict movement of the sealing member 6.

The second support protrusion 32*b* may support the sealing member 6 in the forward direction (FD arrow direction) from the first support protrusion 32*a*. The sealing member 6 may be supported by the second support protrusion 32*b* in the forward direction (FD arrow direction) from the second support protrusion 32*b*. In this case, the second support protrusion 32*b* may be disposed between the sealing member 6 and the first support protrusion 32*a* on the basis of the second axial direction (Y-axis direction). Accordingly, the receptacle connector 1 according to the present invention may implement a double support structure with respect to the sealing member 6 using the second support protrusion 32*b* and the first support protrusion 32*a*. Accordingly, the receptacle connector 1 according to the present invention may further reinforce waterproof performance using the sealing member 6 by reinforcing a support force with respect to the sealing member 6.

The second support protrusion 32*b* and the first support protrusion 32*a* may be disposed to be spaced apart from each other. In this case, the second support protrusion 32*b* may be disposed to be spaced apart from the first support protrusion 32*a* in the forward direction (FD arrow direction). For example, the second support protrusion 32*b* and the first support protrusion 32*a* may be disposed to be spaced apart from each other on the basis of the second direction (Y-axis direction). Since the second support protrusion 32*b* and the first support protrusion 32*a* are disposed to be spaced apart from each other, a buffer groove 32*d* (refer to FIG. 9) may be disposed between the second support protrusion 32*b* and the first support protrusion 32*a*. Due to the buffer groove 32*d*, a space in which the second support protrusion 32*b* is movable toward the first support protrusion 32*a* may be secured. Accordingly, in the receptacle connector 1 according to the present invention, when an external force is applied to the sealing member 6 supported by the second support protrusion 32*b*, the second support protrusion 32*b* may move toward the first support protrusion 32*a* through the buffer groove 32*d* so as to relieve an impact and the like caused by the external force applied to the sealing member 6. Accordingly, the receptacle connector 1 according to the present invention may reduce degradation in waterproof performance, which occurs due to the external force applied to the sealing member 6, using the sealing member 6.

The support protrusion 32 may include a connection support protrusion 32*c* (refer to FIG. 9).

The connection support protrusion 32*c* is configured to connect the first support protrusion 32*a* to the second support protrusion 32*b*. The connection support protrusion 32*c* may be coupled with each of the first support protrusion 32*a* and the second support protrusion 32*b* so as to connect the first support protrusion 32*a* and the second support protrusion 32*b*. The connection support protrusion 32*c* may be formed in the second axial direction (Y-axis direction) so as to connect the first support protrusion 32*a* and the second support protrusion 32*b*. The connection support protrusion 32*c* may connect the first support protrusion 32*a* and the second support protrusion 32*b* from the outside of the first support protrusion 32*a* and the second support protrusion 32*b*. The support member 31 may be formed on the second support protrusion 32*b* to protrude from one end of the second support protrusion 32*b* in the forward direction (FD arrow direction) which is not connected to the connection support protrusion 32*c*.

The connection support protrusion 32*c*, the second support protrusion 32*b*, and the first support protrusion 32*a* may be integrally formed. In this case, the support protrusion 32 may be formed to include the connection support protrusion 32*c*, the second support protrusion 32*b*, and the first support protrusion 32*a* by bending a panel. Accordingly, the connection support protrusion 32*c* may be formed so that an outward surface forms a curve.

Also, as described above, the shell body 30, the support member 31, and the support protrusion 32 may be integrally formed. In this case, the shell 3 may be formed to include the support protrusion 32, which includes the connection support protrusion 32*c*, the second support protrusion 32*b*, and the first support protrusion 32*a*, the support member 31, and the shell body 30 by bending a panel. A process of integrally forming the support protrusion 32, the support member 31, and the shell body 30 will be described in brief as follows.

As described above with reference to FIGS. 5 to 8, the shell 3 may be integrally formed not to have a gap caused by the seam 34 on the outer surface. Subsequently, the support protrusion 32 including the first support protrusion 32*a* connected to the shell body 30, the connection support protrusion 32*c* connected to the first support protrusion 32*a*, and the second support protrusion 32*b* connected to the connection support protrusion 32*c* may be formed between the support member 31 and the shell body 30 by pressurizing the shell 3. For example, the support protrusion 32 formed to protrude outward from the shell body 30 and the support member 31 may be formed by pressurizing one end of the shell 3, on which the support member 31 is to be formed, in the backward direction (BD arrow direction) and pressurizing the other end of the shell 3, on which the shell body 30 is to be formed, in the forward direction (FD arrow direction).

Accordingly, since it is possible to form a structure configured to reduce the number of operations as well as support the sealing member 6, the receptacle connector 1 according to the present invention may reduce manufacturing costs and increase productivity by reducing a manufacturing time in comparison to a comparative example of separately forming the support protrusion 32 on the shell body 30.

Also, the receptacle connector 1 according to the present invention may prevent the size of the shell body 30 from increasing by forming the support protrusion 32 by pressurizing the panel. Accordingly, in comparison to a comparative example of forming a step between the support member 31 and the shell body 30 by increasing a thickness of the shell body 30 to support the sealing member 6, the receptacle connector 1 according to the present invention has an advantage of implementing miniaturization.

Referring to FIGS. 11 and 12, the receptacle connector 1 according to the present invention may include a block portion 53 (refer to FIG. 11) disposed to cover the insulation portion 4.

The block portion 53 is configured to reduce occurrence of emission of a signal through the bottom surface or the rear surface 4*b* of the insulation portion 4. The block portion 53 may be coupled to the cover 5 to cover at least one of the bottom surface and the rear surface 4*b* of the insulation portion 4. Effects according to the block portion 53 will be described in detail as follows.

The shell 3 may be formed so that the front surface 4*a* of the insulation portion 4 and the rear surface 4*b* of the insulation portion 4 are open. In this case, although it is necessary to implement a side of the shell 3 toward the front surface 4*a* of the insulation portion 4 to be opened so as to allow the plug connector to be inserted therein, a side of the shell 3 toward the rear surface 4*b* of the insulation portion 4 only needs to secure a space through which the contacts 2 are mountable on the substrate. Accordingly, emission of signals may unnecessarily occur through the side of the shell 3 toward the rear surface 4*b* of the insulation portion 4. Also, as the side toward the rear surface of the insulation portion 4 is formed to protrude from the shell 3 to secure the space through which the contacts 2 are mountable on the substrate, emission of signals may unnecessarily occur through the bottom surface of the insulation portion 4 which is not covered by the shell 3.

Accordingly, since the receptacle connector 1 according to the present invention includes the block portion 53, performance effects may be promoted as follows.

First, the receptacle connector 1 according to the present invention may reduce occurrence of emission of signals when the signals are transmitted using the block portion 53. Accordingly, the receptacle connector 1 according to the present invention may improve transmission performance with respect to signals.

Second, the receptacle connector 1 according to the present invention may reduce a degree of degradation in performance of another device provided in applied electronic equipment, which is caused by emitted signals. For example, when the receptacle connector 1 according to the present invention is applied to a cellular phone, it is possible to reduce a degree of degradation in performance of an antenna included in the cellular phone, which is caused by emitted signals. Also, even when the receptacle connector 1 according to the present invention is implemented to perform high-speed transmission with respect to signals, it is possible to reduce a degree of degradation in performance of another device provided in applied electronic equipment. Accordingly, since the receptacle connector 1 according to the present invention is implemented so as to allow applied electronic equipment to be equipped with a high-speed transmission function with respect to signals, it is possible to contribute to further improvement in performance of the applied electronic equipment.

Referring to FIGS. 1 to 12, the cover 5 may include an upper cover 51 and a lower cover 52.

The upper cover 51 is disposed to be located above the insulation portion 4. The upper cover 51 may be disposed to cover the top surface of the insulation portion 4 as well as to partially cover both sides of the insulation portion 4.

The lower cover 52 is disposed to be located below the insulation portion 4. The lower cover 52 may be disposed to cover the bottom surface of the insulation portion 4 as well as to partially cover both sides of the insulation portion 4. An entirety of both sides of the insulation portion 4 may be covered by the upper cover 51 and the lower cover 52.

Accordingly, the receptacle connector 1 according to the present invention may promote performance effects as follows.

The receptacle connector 1 according to the present invention is implemented so that the cover 5 is not integrally formed and includes the upper cover 51 and the lower cover 52. Accordingly, in comparison to a comparative example in which the cover 5 is integrally formed and coupled to the shell 3, the receptacle connector 1 according to the present invention has an advantage of reducing a processing cost by decreasing a defect rate of a product.

For example, in the comparative example, the integrally formed cover 5 is coupled to the shell 3 to be located outside the shell 3. In this case, when the cover 5 is not formed to have an accurate size capable of surrounding an outside of the shell 3 due to a manufacturing tolerance and the like, the cover 5 is abandoned as a defective product. In detail, when the cover 5 is formed to be smaller than the outside of the shell 3, the cover 5 may not cover the outside of the shell 3. When the cover 5 is formed to have a certain size greater than the outside of the shell 3 in consideration of a manufacturing tolerance in this case, since the shell 3 cannot be stably fixed due to a gap between the cover 5 and the shell 3, the cover 5 is faulty. However, in the receptacle connector 1 according to the present invention, the cover 5 includes the upper cover 51 and the lower cover 52. The upper cover 51 and the lower cover 52 are coupled to the shell 3 to press against the shell 3 at a top and a bottom of the shell 3 so that there is an advantage of reducing a manufacturing cost by a decreasing a defect rate of a product in comparison to the comparative example.

The lower cover 52 may include a lower cover body 520 (refer to FIG. 12) and a lower mounting member 521 (refer to FIG. 12).

The lower cover body 520 is coupled to the insulation portion 4 below the insulation portion 4. The lower cover body 520 forms an overall exterior of the lower cover 52.

The lower mounting member 521 is configured to be mounted on the substrate. In the receptacle connector 1 according to the present invention, the lower mounting member 521 may be fixed to the substrate using a mounting force of being mounted on the substrate. The lower mounting member 521 may be inserted into a mounting groove (not shown) formed in the substrate. The lower mounting member 521 may be inserted into the mounting groove and mounted to be fixed to the substrate through a solder paste (not shown) applied to the substrate. The lower mounting member 521 may be disposed to face a direction perpendicular to a mounting surface of the substrate. For example, the lower mounting member 521 may be disposed to be parallel to the third axial direction (Z-axis direction).

The lower cover 52 may include a plurality of such lower mounting members 521. In this case, the lower mounting members 521 may be disposed to be located at positions spaced apart from each other on the basis of the first axial direction (X-axis direction). On the basis of the first axial direction (X-axis direction), the insulation portion 4 may be located between the lower mounting members 521.

The upper cover 51 may include an upper cover body 510 (refer to FIG. 12) and an upper mounting member 511 (refer to FIG. 12).

The upper cover body 510 is coupled to the insulation portion 4 above the insulation portion 4. The upper cover body 510 forms an overall exterior of the upper cover 51. The upper mounting member 511 is configured to be mounted on the substrate. In the receptacle connector 1 according to the present invention, the upper mounting member 511 may be fixed to the substrate using a mounting force of being mounted on the substrate. The upper mounting member 511 may be inserted into the mounting groove formed in the substrate. The upper mounting member 511 may be inserted into the mounting groove and mounted to be fixed to the substrate through the solder paste applied to the substrate. The upper mounting member 511 may be disposed to face the direction perpendicular to the mounting surface of the substrate. For example, the upper mounting member 511 may be disposed to be parallel to the third axial direction (Z-axis direction).

The upper mounting member 511 and the lower mounting member 521 may be disposed in parallel to be inserted into one mounting groove formed in the substrate. Accordingly, the receptacle connector 1 according to the present invention may further increase a fixing force with respect to the substrate by increasing a mounting area mounted on the substrate by using the upper mounting member 511 and the lower mounting member 521. In this case, the upper mounting member 511 and the lower mounting member 521 may be arranged in parallel on the basis of the first axial direction (X-axis direction).

The upper cover 51 may be installed on the insulation portion 4 so that the upper mounting member 511 is disposed to be parallel to the lower mounting member 521 as well as the upper mounting member 511 being located at a position spaced from the lower mounting member 521. That is, the upper mounting member 511 and the lower mounting member 521 may be disposed in parallel to be inserted into the mounting groove formed in the substrate while being spaced apart from each other. Accordingly, an accommodation groove (not shown) may be located between the upper mounting member 511 and the lower mounting member 521. The cover 5 may be mounted on the substrate so that the solder paste is accommodated in the accommodation groove. Accordingly, the receptacle connector 1 according to the present invention may further increase the fixing force with respect to the substrate by increasing an amount of the solder paste, which fixes the upper mounting member 511 and the lower mounting member 521 to the substrate, using the accommodation groove.

The upper cover 51 may include a plurality of such upper mounting members 511. In this case, the upper mounting members 511 may be disposed to be located at positions spaced apart from each other on the basis of the first axial direction (X-axis direction). On the basis of the first axial direction (X-axis direction), the lower mounting members 521 may be located between the upper mounting members 511.

Referring to FIGS. 1 to 14, the block portion 53 includes a first block member 53*a* (refer to FIG. 13) for covering a bottom surface 4*c* (refer to FIG. 13) of the insulation portion 4.

The first block member 53*a* may be coupled to the cover 5 and disposed to cover the bottom surface 4*c* of the insulation portion 4. The first block member 53*a* may be coupled to the lower cover 52 and disposed to cover the bottom surface 4*c* of the insulation portion 4.

Accordingly, the first block member 53*a* may reduce occurrence of emission with respect to signals through the bottom surface 4*c* of the insulation portion 4.

The lower cover 52 and the first block member 53*a* may be integrally formed. In this case, the first block member 53*a* may be disposed to connect lower connecting members 522 arranged to be spaced apart from each other along the first axial direction (X-axis direction) and to cover the bottom surface 4*c* of the insulation portion 4.

As shown in FIG. 13, the first block member 53*a* may be coupled to the lower cover 52 to be located in the backward direction (BD arrow direction) with respect to the shell 3. The first block member 53*a* may be coupled to the lower cover 52 to be located between the shell 3 and the mounting members 22 on the basis of the second axial direction (Y-axis direction).

Accordingly, the receptacle connector 1 according to the present invention may promote performance effects as follows.

The receptacle connector 1 according to the present invention may be implemented so that the first block member 53*a* is located between the shell 3 and the mounting members 22 on the basis of the second axial direction (Y-axis direction). Accordingly, the receptacle connector 1 according to the present invention may reduce occurrence of emission with respect to signals through the bottom surface 4*c* of the insulation portion 4 in a separated space between the shell 3 and the substrate, on which the mounting members 22 are mounted, by using the first block member 53*a*.

In detail, the mounting members 22 may be located outside the shell 3 to be mounted on the substrate, and the insulation portion 4 may be installed on the shell 3 to be located outside the shell 3 to support the mounting members 22. Also, when the cover 5, to which the shell 3 is coupled, is fixed to the substrate, the separated space is present between the shell 3 and the substrate, and the bottom surface 4*c* of the insulation portion 4, which supports the mounting members 22, is exposed outward through the corresponding space.

Accordingly, the receptacle connector 1 according to the present invention may reduce occurrence of emission with respect to signals through the bottom surface 4*c* of the insulation portion 4 by blocking the separated space between the shell 3 and the substrate using the first block member 53*a*.

The first block member 53*a* may be formed of a conductive material. In this case, the first block member 53*a* may be grounded. Accordingly, the receptacle connector 1 according to the present invention may further reduce occurrence of emission with respect to signals through the bottom surface 4*c* of the insulation portion 4 by increasing a block force of blocking the emission of signals through the bottom surface 4*c* of the insulation portion 4 using the first block member 53*a*. For example, the first block member 53*a* may be formed of a metal.

The first block member 53*a* may be mounted on the substrate to be grounded through the substrate. In this case, the lower cover 52 may be formed of a conductive material and be mounted on the substrate to be grounded. For example, the lower cover 52 may be formed of a metal. The first block member 53*a* may be integrally formed with the lower cover 52 so as to be grounded through the lower cover 52.

In the receptacle connector 1 according to the present invention, the first block member 53*a* may include a seam member 533*a* (refer to FIG. 11).

The seam member 533*a* is configured to connect a block body 530*a* (refer to FIG. 11) to the shell 3. The seam member 533*a* may be formed so that one end is connected to the block body 530*a* and the other end is connected to the shell 3. The seam member 533*a* may be disposed between the block body 530*a* and the shell 3 on the basis of the third axial direction (Z-axis direction). The seam member 533*a* may be formed on the block body 530*a* to protrude from the block body 530*a* in a downward direction (DD arrow direction shown in FIG. 2).

When the first block member 53*a* includes the seam member 533*a*, the receptacle connector 1 according to the present invention may include a first welding member 36 (refer to FIG. 11) to improve a fixing force of the seam member 533*a* with respect to the shell 3. The first welding member 36 is configured to fix the shell 3 and the seam member 533*a*. The first welding member 36 may be formed by performing laser-welding a through hole (not shown) formed between the shell 3 and the seam member 533*a*.

Referring to FIGS. 1 to 14, the block portion 53 may include a second block member 53*b* (refer to FIG. 11) for covering the rear surface 4*b* of the insulation portion 4.

The second block member 53*b* may be coupled to the cover 5 and disposed to cover the rear surface 4*b* of the insulation portion 4. The second block member 53*b* may be coupled to the upper cover 51 and disposed to cover the rear surface 4*b* of the insulation portion 4. Accordingly, the second block member 53*b* may reduce occurrence of emission with respect to signals through the rear surface 4*b* of the insulation portion 4.

The second block member 53*b* may be formed of a conductive material. In this case, the second block member 53*b* may be grounded. Accordingly, the receptacle connector 1 according to the present invention may further reduce occurrence of emission with respect to signals through the rear surface 4*b* of the insulation portion 4 by increasing a block force of blocking the emission of signals through the rear surface 4*b* of the insulation portion 4 using the second block member 53*b*. For example, the second block member 53*b* may be formed of a metal.

The second block member 53*b* may be mounted on the substrate to be grounded through the substrate. In this case, the upper cover 51 may be formed of a conductive material and be mounted on the substrate to be grounded. For example, the upper cover 51 may be formed of a metal. The second block member 53*b* may be coupled to the upper cover 51 to be electrically connected to the upper cover 51 so as to be grounded through the upper cover 51.

Meanwhile, as shown in FIG. 13, the second block member 53*b* may be formed to have a length capable of being coupled to the upper cover 51 and mounted on the substrate. Also, as the receptacle connector 1 is mounted on the substrate, the rear surface 4*b* of the insulation portion 4 which is not covered by the second block member 53*b* may be covered by the substrate. Accordingly, although only the second block member 53*b* coupled to the upper cover 51 has been described as a component for covering the rear surface 4*b* of the insulation portion 4 in the above embodiment, the present invention is not limited thereto. For example, in consideration of a height at which the receptacle connector 1 according to the present invention is mounted on the substrate, a block portion for covering an entirety of the rear surface 4*b* of the insulation portion 4 may be included. As an example, even the lower cover 52 may include a block portion for covering the rear surface 4*b* of the insulation portion 4.

The receptacle connector 1 according to the present invention includes the second block member 53*b* as a separate component from the upper cover 51 so as to reduce occurrence of emission with respect to signals. In detail, according to a comparative example of integrally forming the second block member 53*b* and the upper cover 51, it is necessary to bend the second block member 53*b* with respect to the upper cover 51 and dispose the second block member 53*b* to cover the rear surface 4*b* of the insulation portion 4. Here, since a bent region is formed between the second block member 53*b* and the upper cover 51 by bending, emission with respect to signals may occur through a gap in the corresponding region.

Accordingly, the receptacle connector 1 according to the present invention may include the second block member 53*b* as a separate component from the upper cover 51 and may reduce occurrence of emission with respect to signals by coupling the second block member 53*b* to the upper cover 51.

The receptacle connector 1 according to the present invention may include a closing member 54 (refer to FIG. 12) so as to further reduce occurrence of emission with respect to signals.

The closing member 54 is configured to block a gap between the upper cover 51 and the second block member 53*b*. The gap between the upper cover 51 and the second block member 53*b* may be formed in a region except a part where the second block member 53*b* is coupled to the upper cover 51. For example, the gap may be formed in a residual part except a part where the second block member 53*b* and the upper cover 51 are connected. The closing member 54 may prevent emission with respect to signals from occurring through the gap between the upper cover 51 and the second block member 53*b* by blocking the gap between the upper cover 51 and the second block member 53*b*. Accordingly, the receptacle connector 1 according to the present invention may further reduce occurrence of emission with respect to signals through the rear surface 4*b* of the insulation portion 4 by further increasing a block force of blocking the emission of signals through the rear surface 4*b* of the insulation portion 4 using the second block member 53*b* and the closing member 54.

The closing member 54 may be implemented to be coupled to each of the upper cover 51 and the second block member 53*b* so as to block the gap between the upper cover 51 and the second block member 53*b*. The closing member 54 may be implemented by performing laser welding on the gap between the upper cover 51 and the second block member 53*b*.

The cover 5 may include a plurality of such closing members 54. The closing members 54 may be coupled to the upper cover 51 and the second block member 53*b* at positions spaced apart from each other. Accordingly, the receptacle connector 1 according to the present invention may reduce a length of each of gaps by partially blocking the gap between the upper cover 51 and the second block member 53*b* using the closing members 54. Accordingly, the receptacle connector 1 according to the present invention may reduce occurrence of emission with respect to signals through the rear surface 4*b* of the insulation portion 4 using the closing members 54. Also, the receptacle connector 1 according to the present invention has advantages of not only reducing manufacturing costs by reducing material costs but also increasing ease of a manufacturing process in comparison to blocking an entirety of the gap between the upper cover 51 and the second block member 53*b*.

Although four closing members 54 are shown in FIG. 12, the present invention is not limited thereto and the closing members 54 may be implemented to block the entirety of the gap between the upper cover 51 and the second block member 53*b*. In this case, the closing members 54 may be formed so that some thereof are overlapped with each other.

Referring to FIGS. 1 to 17, the insulation portion 4 of the receptacle connector 1 according to the present invention may include a first insulation portion 41 (refer to FIG. 15) and a second insulation portion 42 (refer to FIG. 15). The first insulation portion 41 and the second insulation portion 42 may be arranged to be spaced apart along the second axial direction (Y-axis direction). The first insulation portion 41 may be located in the forward direction (FD arrow direction) from the second insulation portion 42.

The first insulation portion 41 may include an insulation body 411 (refer to FIG. 15).

The insulation body 411 is configured to support the contacts 2. The insulation body 411 forms an overall exterior of the first insulation portion 41. The first contacts 2*a* may be coupled to the insulation body 411 so that the connection members 21 are located on a top surface of the insulation body 411. The second contacts 2*b* may be coupled to the insulation body 411 so that the connection members 21 are located on a bottom surface of the insulation body 411. The connection members 21 and the connecting members 23 may be coupled to the insulation body 411. The insulation body 411, the first contacts 2*a*, and the second contacts 2*b* may be implemented to be coupled to one another through insert molding.

The first insulation portion 41 may include a protruding member 412 (refer to FIG. 15).

The protruding member 412 protrudes outward from the insulation body 411. The protruding member 412 may be coupled to the insulation body 411 to protrude outward from the insulation body 411. The protruding member 412 and the insulation body 411 may be integrally formed. The first insulation portion 41 may be inserted into and coupled to the shell 3 so that the protruding member 412 comes into contact with an inner surface 3*a* (refer to FIG. 16) of the shell 3. Accordingly, the protruding member 412 may seal a space between the inner surface 3*a* of the shell 3 and an outer surface of the first insulation portion 41.

The insertion groove 30*a* may be formed to have a size smaller than that of the protruding member 412. On the basis of an X-Z plane formed of an X axis and a Y axis, a part which has a maximum cross section of the protruding member 412 may be formed to have a cross section greater than that of the insertion groove 30*a*. Accordingly, the first insulation portion 41 may be coupled to the shell body 30 through a forcible fitting method using the protruding member 412. Accordingly, the receptacle connector 1 according to the present invention may further reinforce waterproof performance by preventing a potting solution from leaking through a gap between the shell body 30 and the first insulation portion 41.

The second insulation portion 42 is configured to support the contacts 2. The contacts 2 may be coupled to the second insulation portion 42 so that the mounting members 22 are located at the same height. The mounting members 22 and the connecting members 23 may be coupled to the second insulation portion 42. The second insulation portion 42, the first contacts 2*a*, and the second contacts 2*b* may be implemented to be coupled to one another through insert molding.

Referring to FIG. 17, the receptacle connector 1 according to the present invention may include a waterproof portion 9 (refer to FIG. 17). The waterproof portion 9 is configured to implement a waterproofing function. The waterproof portion 9 provides the waterproofing function by sealing a gap between an outer surface of the insulation portion 4 and the inner surface 3*a* of the shell 3. The waterproof portion 9 may be formed to partially surround the contacts 2 so as to implement the waterproofing function with respect to the contacts 2. The waterproof portion 9 may be formed by applying and curing a potting solution to an inside of the shell 3 while the insulation portion 4 is inserted in the shell 3.

In the receptacle connector 1 according to the present invention, on the basis of the second axial direction (Y-axis direction), the waterproof portion 9 may implement a waterproofing function with respect to the contacts 2 located in a separated space S (refer to FIG. 15) between the first insulation portion 41 and the second insulation portion 42 between a front surface 41*a* (refer to FIG. 15) of the first insulation portion 41 and a rear surface 42*a* (refer to FIG. 15) of the second insulation portion 42 other than the rear surface 42*a* of the second insulation portion 42. That is, in the receptacle connector 1 according to the present invention, a position of the waterproof portion 9 changes toward the forward direction (FD arrow direction) in comparison to a conventional technology.

Accordingly, the receptacle connector 1 according to the present invention may prevent positions of the mounting members 22 from being changed due to a change in a volume and the like during a process of curing the potting solution for forming the waterproof portion 9. Accordingly, the receptacle connector 1 according to the present invention may increase a connection force between the mounting members 22 and the substrate by increasing a flatness level with respect to the mounting members 22 and additionally improve connection performance between the plug connector and the substrate.

As a position of the waterproof portion 9 is changed toward the forward direction (FD arrow direction) through the separated space S between the first insulation portion 41 and the second insulation portion 42, the waterproof portion 9 may be formed at a position spaced apart from the mounting members 22 in the forward direction (FD arrow direction). Accordingly, the waterproof portion 9 may be formed to surround the connecting members 23 of the contacts 2 located in the separated space S between the first insulation portion 41 and the second insulation portion 42.

The receptacle connector 1 according to the present invention may include a mid plate 8 (refer to FIG. 2).

The mid plate 8 is configured to connect the first insulation portion 41 to the second insulation portion 42. The mid plate 8 may be coupled to each of the first insulation portion 41 and the second insulation portion 42 so as to connect the first insulation portion 41 to the second insulation portion 42 which are spaced apart from each other along the second axial direction (Y-axis direction). The mid plate 8 may be formed of a material having a greater bonding force with respect to the waterproof portion 9 than those of the first insulation portion 41 and the second insulation portion 42. For example, the mid plate 8 may be formed of a metal, and the first insulation portion 41 and the second insulation portion 42 may be formed of a synthetic resin.

The mid plate 8 may be coupled to each of the first insulation portion 41 and the second insulation portion 42 to be located inside the first insulation portion 41 and the second insulation portion 42. The mid plate 8 may be coupled to the insulation body 411 to be located between the connection members 21 located on a top surface of the insulation body 411 and the connection members 21 located on a bottom surface of the insulation body 411. The mid plate 8 and the contacts 2 may be implemented to be coupled to the first insulation portion 41 and the second insulation portion 42, respectively, through insert molding.

The waterproof portion 9 is formed in the separated space S between the first insulation portion 41 and the second insulation portion 42. The waterproof portion 9 may be formed to partially surround the contacts 2 and the mid plate 8 in the separated space S between the first insulation portion 41 and the second insulation portion 42 so as to implement the waterproofing function with respect to the contacts 2. The waterproof portion 9 may be formed on an entire surface of the inner surface 3*a* of the shell 3 which surrounds the separated space S between the first insulation portion 41 and the second insulation portion 42 so as to completely seal the separated space S between the first insulation portion 41 and the second insulation portion 42.

Accordingly, the receptacle connector 1 according to the present invention may promote performance effects as follows.

The receptacle connector 1 according to the present invention is implemented such that the first insulation portion 41 and the second insulation portion 42 are not integrally formed and are formed as separate components to be disposed to be spaced apart and the first insulation portion 41 and the second insulation portion 42 are connected using the mid plate 8. Also, the waterproof portion 9 is formed to surround the contacts 2 and the mid plate 8 in the separated space S between the first insulation portion 41 and the second insulation portion 42. Accordingly, the waterproofing function with respect to the gap between the receptacle connector 1 according to the present invention and the electronic device may be improved.

In detail, when an integral insulation portion 4 having a through region therein is formed by forming a connecting member between the first insulation portion 41 and the second insulation portion 42 using a synthetic resin which is the same material as those of the first insulation portion 41 and the second insulation portion 42, since the waterproof portion 9 is not be firmly bonded to the connecting member formed using the synthetic resin, water may permeate through a gap occurring between the waterproof portion 9 and the connecting member.

Accordingly, in the embodiment of the present invention, the insulation portion 4 is implemented as a separate component to include the first insulation portion 41 and the second insulation portion 42, the first insulation portion 41 and the second insulation portion 42 are connected using the mid plate 8 formed of a metal, and the waterproof portion 9 is formed in the separated space S between the first insulation portion 41 and the second insulation portion 42 such that the waterproof portion 9 may be firmly bonded to the mid plate 8 and completely prevent water permeation so as to improve waterproof performance.

The mid plate 8 may include a mid body 81 (refer to FIG. 2), a ground member 83 (refer to FIG. 2), and a coupling member 84 (refer to FIG. 2).

The mid body 81 is configured to be coupled to the insulation body 411. The mid body 81 may be coupled to the insulation body 411 so as to reinforce strength of the insulation body 411. The mid body 81 may be coupled to the insulation body 411 to be located between the connection members 21 located on the top surface of the insulation body 411 and the connection members 21 located on the bottom surface of the insulation body 411. The mid body 81 may be formed to have an overall quadrangular plate shape but is not limited thereto and may be formed to have any shape capable of reinforcing the strength of the insulation body 411. The mid body 81 may be formed to have a material having strength greater than that of the insulation body 411. For example, the mid body 81 may be formed of a metal, and the insulation body 411 may be formed of a synthetic resin. The mid body 81 may be coupled to each of the insulation body 411 and the protruding member 412. In this case, a part of the mid body 81 may be coupled to the insulation body 411 and another part thereof may be coupled to the protruding member 412.

The ground member 83 is configured to perform as ground. The ground member 83 may be mounted on the substrate so as to be grounded through the substrate. In this case, the ground member 83 may be mounted on the substrate to be connected to a ground terminal provided on the substrate. The mid plate 8 may be coupled to each of the first insulation portion 41 and the second insulation portion 42 so that at least a part of the ground member 83 is located outside the second insulation portion 42. The ground member 83 may be coupled to the mid body 81. The ground member 83 may be coupled to the mid body 81 to protrude from the mid body 81 in the downward direction (DD arrow direction). The ground member 83 and the mid body 81 may be integrally formed.

The coupling member 84 is configured to connect the first insulation portion 41 to the second insulation portion 42. Since the first insulation portion 41 and the second insulation portion 42 are disposed to be spaced apart from each other along the second axial direction (Y-axis direction), the coupling member 84 may be formed along the second axial direction (Y-axis direction) to connect the first insulation portion 41 to the second insulation portion 42. The coupling member 84 may be located between a restriction member 7 and the ground member 83.

The ground member 83 may be formed on the coupling member 84. The ground member 83 may be coupled to the coupling member 84 to protrude from the coupling member 84 in the downward direction (DD arrow direction). The coupling member 84 and the ground member 83 may be integrally formed.

In the receptacle connector 1 according to the present invention, the mid plate 8 may include a plurality of such ground members 83 and a plurality of such coupling members 84. When the mid plate 8 includes the plurality of ground members 83, the contacts 2 may be located between the ground members 83 on the basis of the first axial direction (X-axis direction). When the mid plate 8 includes the plurality of coupling members 84, the contacts 2 may be located in the separated space S between the coupling members 84 on the basis of the first axial direction (X-axis direction). The contacts 2 may be located between the coupling members 84 included in each of such mid plates 8 on the basis of the first axial direction (X-axis direction).

The waterproof portion 9 may be formed to partially surround the contacts 2 and the coupling members 84 in the separated space S between the first insulation portion 41 and the second insulation portion 42 so as to implement the waterproofing function with respect to the contacts 2.

Referring to FIGS. 16 and 17, the waterproof portion 9 may be formed in the separated space S between the first insulation portion 41 and the second insulation portion 42. The waterproof portion 9 may be formed in the separated space S between the first insulation portion 41 and the second insulation portion 42 through the following processes.

First, as shown in FIG. 16, in a state in which the insulation body 411, to which the contacts 2 are coupled, is coupled to be inserted into the shell 3, the potting solution for forming the waterproof portion 9 is applied to the inside of the shell 3. In the receptacle connector 1 according to the present invention, on the basis of FIG. 16, since the first insulation portion 41 and the second insulation portion 42 are disposed to be spaced apart from each other such that the potting solution may be applied to the inside of the shell 3 from both top and bottom of the second insulation portion 42, the potting solution may be more uniformly filled in comparison to a case of applying the potting solution from one direction of top and bottom.

Next, the potting solution applied to the inside of the shell 3 flows inside the shell 3 to fill in the separated space S between the first insulation portion 41 and the second insulation portion 42. In this case, the shell is erected such that a part to which the potting solution is applied faces a top side. Accordingly, the potting solution may flow to fill in the separated space S between the first insulation portion 41 and the second insulation portion 42 due to gravity.

Next, as shown in FIG. 17, when the separated space S between the first insulation portion 41 and the second insulation portion 42 is filled with the potting solution, the potting solution is cured. Accordingly, the potting solution is implemented as the waterproof portion 9.

Through the above-described processes, the waterproof portion 9 may be formed to be located in the separated space S between the first insulation portion 41 and the second insulation portion 42.

Referring to FIGS. 1 to 19B, the connecting member 23 of the first contact 2*a* may connect the connection member 21 to the mounting member 22 so that the connection member 21 and the mounting member 22 are located in different positions on the basis of the third axial direction (Z-axis direction). In this case, the connecting member 23 may include a bent member 231. The bent member 231 may be formed by being bent on the basis of the third axial direction (Z-axis direction).

The connecting member 23 of the second contact 2*b* may connect the connection member 21 to the mounting member 22 such that the connection member 21 and the mounting member 22 are located in different positions on the basis of the first axial direction (X-axis direction). In this case, the connecting member 23 may include a tilted member 232. The tilted member 232 may be disposed to face a direction tilted at a certain angle on the basis of the second axial direction (Y-axis direction).

According to positions at which the second contacts 2 are arranged on the basis of the first axial direction (X-axis direction), the second contacts 2*b* may include the tilted members 232 implemented to face directions tilted at different angles.

The connecting member 23 of the second contact 2*b* may connect the connection member 21 to the mounting member 22 such that the connection member 21 and the mounting member 22 are located in different positions on the basis of the third axial direction (Z-axis direction). In this case, the connecting member 23 may include a bent member 231. The bent member 231 may be formed by being bent on the basis of the third axial direction (Z-axis direction).

Referring to FIGS. 18A and 19A, the first contacts 2*a* and the second contacts 2*b* may be formed to have irregular lengths in the first axial direction (X-axis direction). The connecting members 23 of the first contacts 2*a* and the connecting members 23 of the second contacts 2*b* may be formed to have irregular lengths on the basis of the first axial direction (X-axis direction).

The connecting members 23 may be formed such that a length 23A of a region coupled to the first insulation portion 41 and the second insulation portion 42 may be longer than a length 23B of a region surrounded by the waterproof portion 9.

Accordingly, the receptacle connector 1 according to the present invention may promote performance effects as follows.

First, the receptacle connector 1 according to the present invention may improve connection performance between the plug connector and the substrate by increasing an area to which the plug connector is connected and an area of being mounted on the substrate by forming the longer lengths 23A of the connection members 21 and the connecting member 23 coupled to the first insulation portion 41 and the second insulation portion 42.

Second, the receptacle connector 1 according to the present invention may further improve waterproof performance with respect to the contacts 2 by increasing a space in which the waterproof portion 9 is formed by forming the shorter length 23B of the region surrounded by the waterproof portion 9.

Referring to FIGS. 1 and 20, when the separated space S is formed between the first insulation portion 41 and the second insulation portion 42, the waterproof portion 9 may be implemented as follows.

The waterproof portion 9 may be formed in the separated space S between the first insulation portion 41 and the second insulation portion 42 to surround four sides of each of the first contacts 2*a* and the second contacts 2*b* located in the separated space S between the first insulation portion 41 and the second insulation portion 42. Accordingly, since the waterproof portion 9 is formed to surround four sides of each of the first contacts 2*a* and the second contacts 2*b*, the receptacle connector 1 according to the present invention may implement complete waterproofness with respect to the first contacts 2*a* and the second contacts 2*b*. Accordingly, the receptacle connector 1 according to the present invention may improve waterproof performance with respect to the first contacts 2*a* and the second contacts 2*b*.

The waterproof portion 9 may be formed to surround four sides of the connecting member 23 of each of the first contact 2*a* and the second contact 2*b*.

When the mid plate 8 includes the plurality of coupling members 84, coupling members 84*a* and 84*b* are located in different positions on the basis of the first axial direction (X-axis direction). The first contacts 2*a* and the second contacts 2*b* may be located between the coupling members 84*a* and 84*b* on the basis of the first axial direction (X-axis direction).

Referring to FIGS. 1 to 22, the receptacle connector 1 according to the present invention may include the restriction member 7 (refer to FIG. 2).

The restriction member 7 is configured to restrict a distance by which the plug connector is inserted into the shell 3. The restriction member 7 may be coupled to the protruding member 412 to be located in the forward direction (FD arrow direction) of the protruding member 412. Accordingly, the plug connector comes into contact with the restriction member 7 while moving in the backward direction (BD arrow direction) and being inserted into the shell 3 so as to be stopped moving in the backward direction (BD arrow direction). That is, the restriction member 7 functions as a stopper with respect to the plug connector. Accordingly, the receptacle connector 1 according to the present invention may promote performance effects as follows.

First, the receptacle connector 1 according to the present invention is implemented to restrict a distance, by which the plug connector moves in the backward direction (BD arrow direction) and is inserted into the shell 3, using the restriction member 7. Accordingly, the receptacle connector 1 according to the present invention may prevent the plug connector from being damaged by being inserted by an excessive distance into the shell 3 or prevent waterproof performance from being degraded using the restriction member 7.

Second, the receptacle connector 1 according to the present invention implements a stopper function with respect to the plug connector using the restriction member 7 formed separately from the insulation portion 4. Accordingly, the receptacle connector 1 according to the present invention may reduce an impact transferred to the insulation portion 4 in comparison to a comparative example of implementing a stopper function with respect to the plug connector using a part of the insulation portion 4. For example, as a process of inserting and releasing the plug connector into and from the receptacle connector 1 is repetitively performed, an impact occurs. Here, when the stopper function with respect to the plug connector is implemented using a part of the insulation portion 4, the impact is entirely transferred to the contacts 2 installed on the insulation portion 4 such that a mounting state of the substrate and the contacts 2 may be degraded. Accordingly, since the receptacle connector 1 according to the present invention may disperse the impact transferred to the insulation portion 4 by implementing the stopper function with respect to the plug connector using the restriction portion 7, durability may be improved.

Third, the receptacle connector 1 according to the present invention implements the stopper function with respect to the plug connector using the separate restriction member 7 without processing the shell 3. Accordingly, the receptacle connector 1 according to the present invention may implement the stopper function with respect to the plug connector even without processing the shell 3 in comparison to a comparative example of implementing a stopper function with respect to the plug connector by processing the shell 3 such that a part of the shell 3 protrudes toward the inside of the shell 3. Accordingly, the receptacle connector 1 according to the present invention has an advantage of implementing the stopper function with respect to the plug connector while maintaining waterproof performance of the shell 3 in comparison to the comparative example in which the part of the shell 3 is processed to protrude toward the inside of the shell 3 such that waterproof performance is degraded. Meanwhile, in the comparative example, when a hole is generated in the shell 3 due to processing the part of the shell 3 to protrude toward the inside of the shell 3, it is necessary to perform an additional operation on the shell 3 to block the generated hole. On the other hand, since the receptacle connector 1 according to the present invention may maintain waterproof performance of the shell 3 as well as implement the stopper function with respect to the plug connector without an additional operation on the shell 3, there is an advantage of reducing manufacturing costs by reducing an operation cost in comparison to the comparative example.

A plurality of such restriction members 7 may be formed. The restriction members 7 may be coupled to the protruding member 412 at positions spaced apart from each other on the basis of the third axial direction (Z-axis direction).

The restriction member 7 may include a restriction body 70 (refer to FIG. 21).

The restriction body 70 is configured to come into contact with the protruding member 412. The restriction body 70 may form an overall exterior of the restriction member 7. The restriction body 70 may be disposed to be located in the forward direction (FD arrow direction) of the protruding member 412 so as to restrict the distance in which the plug connector is inserted into the shell 3.

The restriction member 7 may include a fixing member 71 (refer to FIG. 22) and a fixing protrusion 72 (refer to FIG. 22).

The fixing member 71 is configured to fix the restriction body 70 to the protruding member 412. The fixing member 71 is formed to protrude from the restriction body 70. The fixing member 71 may be formed to have a quadrangular cross section. The fixing member 71 is formed to protrude from the restriction body 70 in the backward direction (BD arrow direction).

The fixing protrusion 72 is formed to protrude from the fixing member 71. The fixing protrusion 72 may be formed on the fixing member 71 to protrude in an inward direction from the fixing member 71 toward the protruding member 412. On the basis of the second axial direction (Y-axis direction), the fixing protrusion 72 may be formed to have a length shorter than that of the fixing member 71. The fixing protrusion 72 may be formed to protrude in the inward direction by bending a part of the fixing member 71.

The restriction member 7 may include a plurality of such fixing protrusions 72. In this case, the fixing protrusions 72 may be formed at positions spaced apart from each other on the basis of the first axial direction (X-axis direction).

When the restriction member 7 includes the fixing protrusion 72, the protruding member 412 may include a fixing groove 412*a* (refer to FIG. 22). The fixing groove 412*a* may be formed to be recessed at a certain depth from the protruding member 412. The fixing groove 412*a* may be formed to have a rectangular parallelepiped shape having a long length along the first axial direction (X-axis direction) but is not limited thereto and may be formed to have a different shape.

The restriction member 7 may be coupled to the protruding member 412 so that the fixing protrusion 72 is inserted into the fixing groove 412*a*. Accordingly, when the restriction member 7 is coupled to the protruding member 412, the fixing protrusion 72 may be firmly supported by the fixing groove 412*a* to be fixed.

When the restriction member 7 includes the plurality of such fixing protrusions 72, the protruding member 412 may include a plurality of such fixing grooves 412*a*. The fixing grooves 412*a* may be formed at positions spaced apart from each other on the basis of the first axial direction (X-axis direction).

The restriction body 70, the fixing member 71, and the fixing protrusion 72 may be integrally formed. The restriction member 7 may be formed to have a material having strength greater than that of the insulation portion 4. For example, the restriction member 7 may be formed of a metal, and the insulation portion 4 may be formed of a synthetic resin.

Accordingly, in the receptacle connector 1 according to the present invention, since the restriction member 7 and the shell 3, which are formed of the same materials, are coupled, the insulation portion 4 may be more firmly fixed to the shell 3 in comparison to a comparative example in which the shell 3 formed of a metal and the insulation portion 4 formed of a synthetic resin are directly coupled.

When the shell 3 and the restriction member 7 are formed of metals, the receptacle connector 1 according to the present invention may include a second welding member 37 (refer to FIG. 11) to improve a fixing force of the insulation portion 4 with respect to the shell 3. The second welding member 37 is configured to fix the shell 3 to the restriction member 7. The second welding member 37 may be formed by performing laser-welding a through hole (not shown) formed to pass through the shell 3.

Accordingly, the receptacle connector 1 according to the present invention may increase a fixing force between the insulation portion 4 and the shell 3 by firmly fixing the restriction member 7 coupled to the insulation portion 4 to the shell 3 and may maintain a stable fixing force even when an impact occurs as the plug connector is inserted into and released from the receptacle connector 1.

The present invention is not limited to the above-described embodiments and the attached drawings, and it will be apparent to one of ordinary skill in the art that various substitutions, modifications, and alterations may be made without departing from the scope of the present invention.

The invention claimed is:

1. A receptacle connector comprising:

a plurality of contacts configured to electrically connect a plug connector to a substrate coupled to an electronic device;

an insulation portion to which the contacts are coupled;

a shell to which the insulation portion is coupled;

a cover to which the shell is coupled; and a sealing member coupled to the shell to seal a space between the electronic device and the shell, wherein the shell comprises a shell body to which the cover is coupled, a support member to which the sealing member is coupled, and a support protrusion integrally formed with the support member, and the support member is coupled to the cover to protrude from the cover in a forward direction and to be located outside the cover, wherein the support protrusion is formed on the support member to protrude from the support member in an outward direction and to restrict a movable distance of the sealing member in a backward direction, and wherein the support member is formed to have a thickness greater than that of the shell body.

2. The receptacle of claim 1, wherein the support member comprises a first support member formed to extend from the shell body in the forward direction, a second support member to which the sealing member is coupled, and a connection support member configured to connect the first support member to the second support member so that the second support member is located outside the first support member, and wherein the support protrusion is formed on the second support member to protrude from one end of the second support member, which is not connected to the connection support member, in the outward direction.

3. The receptacle connector of claim 2, wherein the connection support member has a curved surface which faces the forward direction.

4. The receptacle connector of claim 1, wherein the support member comprises a first support member formed to extend from the shell body in the forward direction and a second support member configured to support the sealing member, wherein the sealing member is supported by the second support member from the outside of the second support member, and wherein the second support member supports the sealing member from the outside of the first support member to implement a double support structure with respect to the sealing member with the first support member.

5. The receptacle connector of claim 4, wherein the second support member is disposed to the outside of the first support member to be spaced apart from the first support member, and wherein a separation groove is disposed between the second support member and the first support member so that the second support member is movable toward the first support member.

6. The receptacle connector of claim 1, wherein the support protrusion is formed on the support member to protrude from the support member further outward than the sealing member.

7. The receptacle connector of claim 1, wherein the support member is formed to have a length longer than that of the sealing member so that one end thereof is located in the forward direction from the sealing member.

8. The receptacle connector of claim 1, further comprising a block portion coupled to the cover, wherein the shell comprises an insertion groove formed to pass through the shell body to allow the plug connector to be inserted therein, wherein the insulation portion is installed on the shell body so that a rear surface protrudes from the insertion groove, and wherein the block portion comprises a first block member coupled to the cover to cover a bottom surface of the insulation portion which protrudes from the insertion groove.

9. The receptacle connector of claim 8, wherein the first block member is formed of an electrically conductive material and is grounded.

10. The receptacle connector of claim 8, wherein the cover comprises an upper cover coupled to the shell above the shell and a lower cover coupled to the shell below the shell, and wherein the first block member is coupled to the lower cover and covers a bottom surface of the insulation portion.

11. The receptacle connector of claim 8, wherein the block portion further comprises a second block member coupled to the cover to cover the rear surface of the insulation portion.

12. The receptacle connector of claim 11, wherein the cover comprises an upper cover coupled to the shell above the shell and a lower cover coupled to the shell below the shell, and wherein the second block member is coupled to the upper cover and covers the rear surface of the insulation portion.

13. The receptacle connector of claim 8, further comprising a mid plate coupled to the insulation portion, wherein the contacts are arranged to be spaced apart from each other along a first axial direction, wherein the insulation portion comprises a first insulation portion and a second insulation portion disposed to be spaced apart from each other along a second axial direction perpendicular to the first axial direction, and wherein the first insulation portion and the second insulation portion are connected by the mid plate.

14. The receptacle connector of claim 13, further comprising a waterproof portion configured to seal a space between an inner surface of the shell and an outer surface of the insulation portion, wherein the waterproof portion is formed to surround four sides of the contacts located in a separated space between the first insulation portion and the second insulation portion and the mid plate.

15. The receptacle connector of claim 14, wherein the mid plate is formed of a material having a bonding force with respect to the waterproof portion which is greater than those of the first insulation portion and the second insulation portion.

16. A receptacle connector comprising:

a plurality of contacts configured to electrically connect a plug connector to a substrate coupled to an electronic device;

an insulation portion to which the contacts are coupled;

a shell to which the insulation portion is coupled;

a cover to which the shell is coupled; and a sealing member coupled to the shell to seal a space between the electronic device and the shell, wherein the shell comprises a shell body to which the cover is coupled, a support member to which the sealing member is coupled, and a support protrusion integrally formed with the support member, and the support member is coupled to the cover to protrude from the cover in a forward direction and to be located outside the cover, wherein the support protrusion is formed on the support member to protrude from the support member in an outward direction and to restrict a movable distance of the sealing member in a backward direction, and wherein the support member is formed to have a thickness equal to that of the shell body.

17. The receptacle connector of claim 16, wherein the support protrusion comprises a first support protrusion formed to protrude from the shell body in the outward direction, a second support protrusion formed in front of the first support protrusion, and a connection support protrusion configured to connect the first support protrusion to the second support protrusion from the outside of the first support protrusion and the second support protrusion, and wherein the support member is formed to protrude from one end of the second support protrusion, which is not connected to the connection support protrusion, in the forward direction.

18. The receptacle connector of claim 17, wherein the connection support protrusion has a curved region which protrudes outermost.

19. The receptacle connector of claim 16, wherein the support protrusion comprises a first support protrusion formed to protrude from the shell body in the outward direction and a second support protrusion formed in front of the first support protrusion, wherein the sealing member is supported by the second support protrusion in the forward direction from the second support protrusion, and wherein the second support protrusion supports the sealing member in the forward direction from the first support protrusion to implement a double support structure with respect to the sealing member with the first support protrusion.

20. The receptacle connector of claim 19, wherein the second support protrusion is disposed to be spaced apart from the first support protrusion in the forward direction from the first support protrusion, and wherein a buffer groove is disposed between the second support protrusion and the first support protrusion so that the second support protrusion is movable toward the first support protrusion.

* * * * *